US010339861B2

(12) United States Patent
Kim et al.

(10) Patent No.: US 10,339,861 B2
(45) Date of Patent: Jul. 2, 2019

(54) ORGANIC LIGHT EMITTING DIODE DISPLAY DEVICE AND DRIVING METHOD THEREOF

(71) Applicant: LG DISPLAY CO., LTD., Seoul (KR)

(72) Inventors: Tae Gung Kim, Paju-si (KR); Jung Hyeon Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 534 days.

(21) Appl. No.: 14/980,871

(22) Filed: Dec. 28, 2015

(65) Prior Publication Data

US 2016/0189625 A1 Jun. 30, 2016

(30) Foreign Application Priority Data

Dec. 29, 2014 (KR) ..... 10-2014-0192089

(51) Int. Cl.
*G09G 3/3233* (2016.01)

(52) U.S. Cl.
CPC ... *G09G 3/3233* (2013.01); *G09G 2300/0861* (2013.01); *G09G 2320/0295* (2013.01); *G09G 2320/045* (2013.01)

(58) Field of Classification Search
CPC combination set(s) only.
See application file for complete search history.

(56) References Cited

U.S. PATENT DOCUMENTS

2010/0085282 A1 4/2010 Yu et al.
2012/0019505 A1* 1/2012 Hwang ..... G09G 3/3233 345/212
2014/0022289 A1 1/2014 Lee et al.
2014/0062843 A1 3/2014 Yang et al.
2014/0118235 A1 5/2014 Hong et al.
2014/0176525 A1 6/2014 Woo et al.
2015/0145754 A1* 5/2015 Yang ..... G09G 3/3233 345/76

FOREIGN PATENT DOCUMENTS

CN 101714329 A 5/2010
CN 103578411 A 2/2014
CN 103794184 A 5/2014

* cited by examiner

*Primary Examiner* — William Boddie
*Assistant Examiner* — Alecia D English
(74) *Attorney, Agent, or Firm* — Birch, Stewart, Kolasch & Birch, LLP

(57) ABSTRACT

An organic light emitting diode display device according to an embodiment includes pixels each configured with an organic light emitting diode and a driving switch used to control a current flowing through the organic light emitting diode. The organic light emitting diode display device compensates a deterioration property of the organic light emitting diode after properties of the driving switch is compensated. As such, the deterioration property of the organic light emitting diode can be maximally reflected to a sensing data. In accordance therewith, the deterioration property of the organic light emitting diode can be accurately compensated.

10 Claims, 24 Drawing Sheets

ORGANIC LIGHT EMITTING DIODE DISPLAY DEVICE AND DRIVING METHOD THEREOF

The present application claims priority under 35 U.S.C. § 119(a) of Korean Patent Application No. 10-2014-0192089 filed on Dec. 29, 2014, which is hereby incorporated by reference in its entirety.

BACKGROUND OF THE INVENTION

Field of the Disclosure

The present application relates to an organic light emitting diode display device and a driving method thereof.

Description of the Related Art

Recently, a variety of flat panel display (FPD) devices adapted to reduce weight and volume corresponding to disadvantages of cathode ray tube (CRT) are being developed. The flat panel display devices include liquid crystal display (LCD) devices, field emission display (FED) devices, plasma display panels (PDPs), electroluminescence devices and so on.

The PDPs have advantages such as simple structure, simple manufacture procedure, lightness and thinness, and are easy to provide a large-sized screen. In view of these points, the PDPs attract public attention. However, the PDPs have serious problems such as low light emission efficiency, low brightness and high power consumption. Also, thin film transistor LCD devices use thin film transistors as switching elements. Such thin film transistor LCD devices are being widely used as the flat display devices. However, the thin film transistor LCD devices have disadvantages such as a narrow viewing angle and a low response time, because of being non-luminous devices. Meanwhile, the electroluminescence display devices are classified into an inorganic light emitting diode display device and an organic light emitting diode display device on the basis of the formation material of a light emission layer. The organic light emitting diode display device corresponding to a self-illuminating display device has features such as high response time, highlight emission efficiency, high brightness and wide viewing angle.

The organic light emitting diode display device controls a voltage between a gate electrode and a source electrode of a driving transistor. As such, an electric current flowing from a drain electrode of the driving transistor toward a source electrode of the driving transistor can be controlled.

The current passing through the drain and source electrodes of the driving transistor is applied to an organic light emitting diode and allows the organic light emitting diode to emit light. Light emission quantity of the organic light emitting diode can be controlled by adjusting the current quantity flowing into the organic light emitting diode.

The current applied to the organic light emitting diode is largely affected with a threshold voltage Vth and mobility of the driving transistor. As such, methods of compensating for the threshold voltage and mobility of the driving transistor are being researched and applied. Nevertheless, the current flowing through the organic light emitting diode can be varied due to the deterioration degree of the organic light emitting diode. In accordance therewith, the current of the organic light emitting diode must be compensated on the basis of a sensed deterioration degree of the organic light emitting diode. However, it is difficult to detect the deterioration degree of the organic light emitting diode. This results from the fact that properties of the driving transistor are reflected to the sensed information when the deterioration degree of the organic light emitting diode is sensed.

To address this matter, external compensation methods of sensing and compensating the properties of the driving transistor and the threshold voltage of the organic light emitting diode are being researched and applied. The external compensation method for sensing the threshold voltage and mobility of the driving transistor and the deterioration degree of the organic light emitting diode must require a large number of memories.

Also, the properties of the driving transistor and the organic light emitting diode are sensed and reflected into compensation data. To this end, the sensed data must be transferred to a timing controller. Then, the sensed data can be skewed. Due to this, errors can be generated in the sensed data and the compensation data.

In order to solve this problem, a method of controlling a delay time is being used. However, the delay control method cannot sense real-time data (or variations thereof) generated at a real (or normal) operation, not an initial setup operation.

BRIEF SUMMARY OF THE INVENTION

Accordingly, embodiments of the present application are directed to an organic light emitting diode display device and a driving method thereof that substantially obviate one or more of problems due to the limitations and disadvantages of the related art, as well to a light source module and a backlight unit each using the same.

The embodiments are to provide an organic light emitting diode display device and a driving method which are adapted to accurately control a current flowing through an organic light emitting diode by detecting a threshold voltage of a driving transistor.

Also, the embodiments are to provide an organic light emitting diode display device and a driving method which are adapted to accurately sense an operation voltage of an organic light emitting diode by minimizing a mobility component of a driving transistor through a mobility compensation of the driving switch.

Moreover, the embodiments are to provide an organic light emitting diode display device and a driving method which are adapted to reduce the number of memories by sensing an operation voltage of an organic light emitting diode using a pixel structure, which is suitable to internally compensate for mobility of a driving switch, and removing a separated memory which is used to store a sensed mobility value of the driving switch.

Furthermore, the embodiments are to provide an organic light emitting diode display device and a driving method which are adapted to prevent the generation of any data communication error by receiving sensed data using internal clocks with different phases from each other.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

In order to address the problems of the related art, a gate driver according to a general aspect of the present embodiment includes a display panel loaded with pixels. The pixels each includes: a scan switch configure to apply one of a sensing voltage and a compensation data voltage on a data line to a first node in response to a scan pulse; a sensing switch configured to apply a reference voltage on a sensing line to a second node in response to a sensing control signal; a storage capacitor connected between the first and second nodes; a driving switch configured to adjust a current on the basis of a voltage between the first and second nodes; and an organic light emitting diode connected between the second node. Such an organic light emitting diode display device allows the properties of the driving switch to be internally compensated. As such, the property of the organic light emitting diode can be accurately detected.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
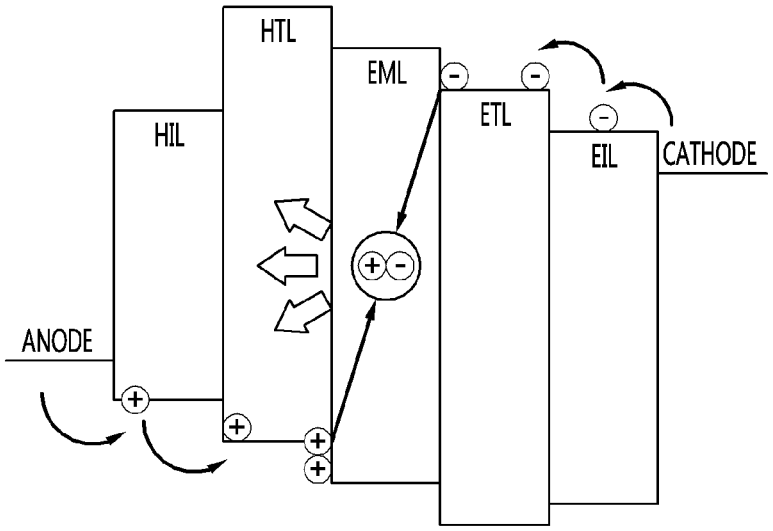
FIG. 1 is a schematic diagram showing the structure of an organic light emitting diode according to an embodiment of the present invention.

Reference will now be made in detail to an OLED display device and a driving method thereof in accordance with the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

Advantages and features of the present disclosure, and implementation methods thereof will be clarified through the following embodiments described with reference to the accompanying drawings. These embodiments introduced hereinafter are provided as examples in order to convey their spirits to the ordinary skilled person in the art. As such, these embodiments might be embodied in a different shape, so are not limited to these embodiments described here. Therefore, the present disclosure must be defined by scopes of claims. The same reference numbers will be used throughout this disclosure to refer to the same or like parts. The size or the relative size of a layer or a region in the drawings can be exaggerated for the definiteness of explanation.

In the description of embodiments, when an element or a layer is described as being disposed "on or above" another element or layer, this description should be construed as including a case in which the elements or layers contact each other as well as a case in which a third element or layer is interposed therebetween. On the contrary, if an element is described as being "directly on" or "just on" another element, it is represented that any third element is not interposed therebetween.

The relative spatial terms, such as "below or beneath", "lower", "above", "upper" and so on, are used for easily explaining mutual relations between "a component or components" and "another component or different components" shown in the drawings. As such, the relative spatial terms should be construed as including a direction of the component shown in the drawings as well as different directions of the component from one another at a use or an operation. For example, when an element reversely shown in the drawings is described as being disposed "below or beneath" another element, the element can be disposed "above" another element. Therefore, "below or beneath" used as an example of the relative spatial term can include both of "below or beneath" and "above".

The terms within the present disclosure are used for explaining embodiments, but they do not limit the present disclosure. As such, the singular forms used in the present disclosure are intended to include the plural forms, unless the context clearly indicates otherwise. The terms "comprises" and/or "comprising" described in the present disclosure specify the presence of stated components, steps, operations and/or elements, but do not preclude the presence or addition of one or more other components, steps, operations, elements and/or groups thereof.

[Structure of Organic Light Emitting Diode]

FIG. 1 is a schematic diagram showing the structure of an organic light emitting diode.

An organic light emitting diode display device can include organic light emitting diodes shown in FIG. 1. All the components of the organic light emitting diode display device according to all the embodiments of the present disclosure are operatively coupled and configured.

The organic light emitting diode can include organic compound layers HIL, HTL, EML, ETL and EIL formed between an anode electrode and a cathode electrode.

The organic compound layers can include a hole injection layer HIL, a hole transport layer HTL, an emission layer EML, an electron transport layer ETL and an electron injection layer EIL.

If a driving voltage is applied between the anode electrode and the cathode electrode, holes passing through the hole transport layer HTL and electrons passing through the electron transport layer ETL are drifted into the emission layer EML. As such, excitons are formed within the emission layer EML. In accordance therewith, visual light can be emitted from the emission layer EML.

Also, the emission layer EML can include one of a red emission layer displaying red, a green emission layer displaying green and a blue emission layer displaying blue according whether any one of color is displayed by the respective organic light emitting diode. The red emission layer, the green emission layer and the blue emission layer can be prepared by differently doping different types of dopants in different densities. Alternatively, the emission layer EML can be formed in a stacked structure of the red emission layer, the green emission layer and the blue emission layer in order to provide a white organic light emitting diode.

The organic light emitting diode display device is configured with pixels, which are arranged in a matrix shape and each include the above-mentioned organic light emitting diode. Brightness of the pixel selected by a scan pulse can be controlled on the basis of a gray scale value of digital video data.

Such an organic light emitting diode display device can be classified into a passive matrix mode and an active matrix mode which uses thin film transistors as switch elements.

Among the organic light emitting diode display devices, the active matrix mode selects the pixels by selectively turning-on the thin film transistors. The selected pixel can maintain a light emitting state using a voltage charged into a storage capacitor within the pixel.

[Equivalent Circuit Diagram of Active Matrix Mode Pixel]

Figure 2:
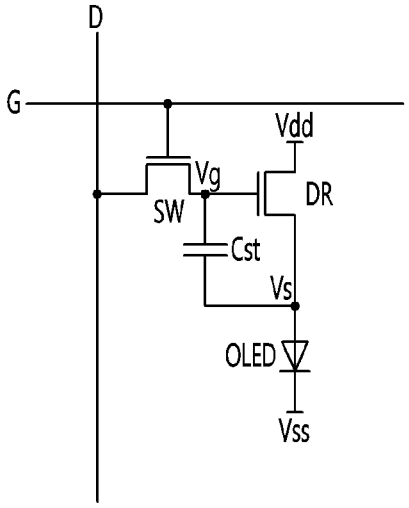
FIG. 2 is an equivalent circuit diagram showing a single pixel included in an organic light emitting diode display device according to an embodiment of the present invention.

FIG. 2 is an equivalent circuit diagram showing a single pixel included in an organic light emitting diode display device according to an embodiment of the present disclosure.

Referring to FIG. 2, each of the pixels within the organic light emitting diode display device according to an embodiment of the present disclosure includes an organic light emitting diode OLED, a data line D and a gate lines G, a scan switch SW configured to transfer a data voltage in response to a scan pulse SP on the gate line G, a driving switch DR configured to generate a current on the basis of a voltage between gate and source electrodes, and a storage capacitor Cst configured to store the data voltage for a fixed period. As the scan switch SW and the driving switch DR, n-type MOS-FETs (metal oxide semiconductor-field effect transistors) can be used.

Such a configuration including two transistors SW and DR and one capacitor Cst is called a 2T-1C configuration.

The scan switch SW is turned-on (or activated) in response to a scan pulse SP from the gate line G. As such, a current path between a source electrode and a drain electrode of the switching switch SW is formed.

During a turned-on time interval of the scan switch SW, a data voltage is transferred from the data line D to a gate electrode of the driving switch DR and the storage capacitor Cst via the source electrode and the drain electrode of the scan switch SW.

The driving switch DR controls an electric current (or a current quantity) flowing through the organic light emitting diode OLED on the basis of a different voltage Vgs between the gate electrode and a source electrode of the driving switch DR.

The storage capacitor Cst stores the data voltage applied to its one electrode. Such a storage capacitor Cst constantly maintains the voltage applied to the gate electrode of the driving switch DR during a single frame period.

The organic light emitting diode OLED with the structure shown in FIG. 1 is connected between the source electrode of the driving switch DR and a low potential driving voltage line Vss. The low potential driving voltage line Vss is connected to a low potential driving voltage source Vss.

The current flowing through the organic light emitting diode OLED is proportioned to brightness of the pixel. Also, the current flowing through the organic light emitting diode OLED depend on the voltage between the gate and source electrodes of the driving switch DR.

The pixel with the configuration shown in FIG. 2 can have brightness in proportion to the current (or current quantity) flowing through the organic light emitting diode OLED, as represented by the following equation 1.

$$V_{gs} = V_g - V_s \quad \text{[Equation 1]}$$

$$V_g = V_{data},\ V_s = V_{init}$$

$$I_{oled} = \frac{\beta}{2}(V_{gs} - V_{th})^2 = \frac{\beta}{2}(V_{data} - V_{init} - V_{th})^2$$

In the equation 1, 'Vgs' is the different voltage between a gate voltage Vg and a source voltage Vs of the driving switch DR, 'data' is the data voltage, and 'Vinit' is an initialization voltage. Also, 'Ioled' is a driving current of the organic light emitting diode OLED, 'Vth' is a threshold voltage of the driving switch DR, and 'β' means a constant value which is determined by mobility and parasitic capacitance of the driving switch DR.

As seen from the equation 1, it is evident that the current (or current quantity) Ioled of the organic light emitting diode OLED is largely affected by the threshold voltage Vth of the driving switch DR. As such, the degree of uniformity throughout an image depends on property deviations of the driving switch DR, i.e., deviations in mobility and threshold voltage of the driving switch DR.

The driving switch DR included in the organic light emitting diode display device can be formed on the basis of one of amorphous silicon (a-Si) and low temperature polycrystalline silicon (LTPS).

The amorphous silicon driving switch very uniformly maintains properties but has a matter of stability such as a shift of the threshold voltage. Also, as the amorphous silicon driving switch has low mobility, it is difficult to directly form a driving cell circuit on a panel. On the other hand, the LTPS driving switch has superior stability and high mobility, but causes deviation between the pixels in threshold voltage and mobility to become larger due to irregularity of grain boundaries.

Also, the current Ioled of the organic light emitting diode OLED is affected by not only the threshold voltage and mobility properties of the driving switch DR but also the deterioration property of the organic light emitting diode OLED. Due to this, although the threshold voltage and the mobility of the driving switch DR are compensated by driving the driving switch DR using the compensation data voltage, image stitching can be caused by the deterioration property of the organic light emitting diode OLED. As such, it is necessary to detect and compensate the deterioration property of the organic light emitting diode OLED.

Moreover, when the deterioration property of the organic light emitting diode OLED is detected, the deterioration property of the driving switch DR can be included in the detected information. As such, it is difficult to accurately detect the deterioration property of the organic light emitting diode OLED. In accordance therewith, it is necessary to remove the deterioration property of the driving switch DR when the deterioration property of the organic light emitting diode OLED is detected.

[Block Diagram of Organic Light Emitting Diode Display Device]

Figure 3:
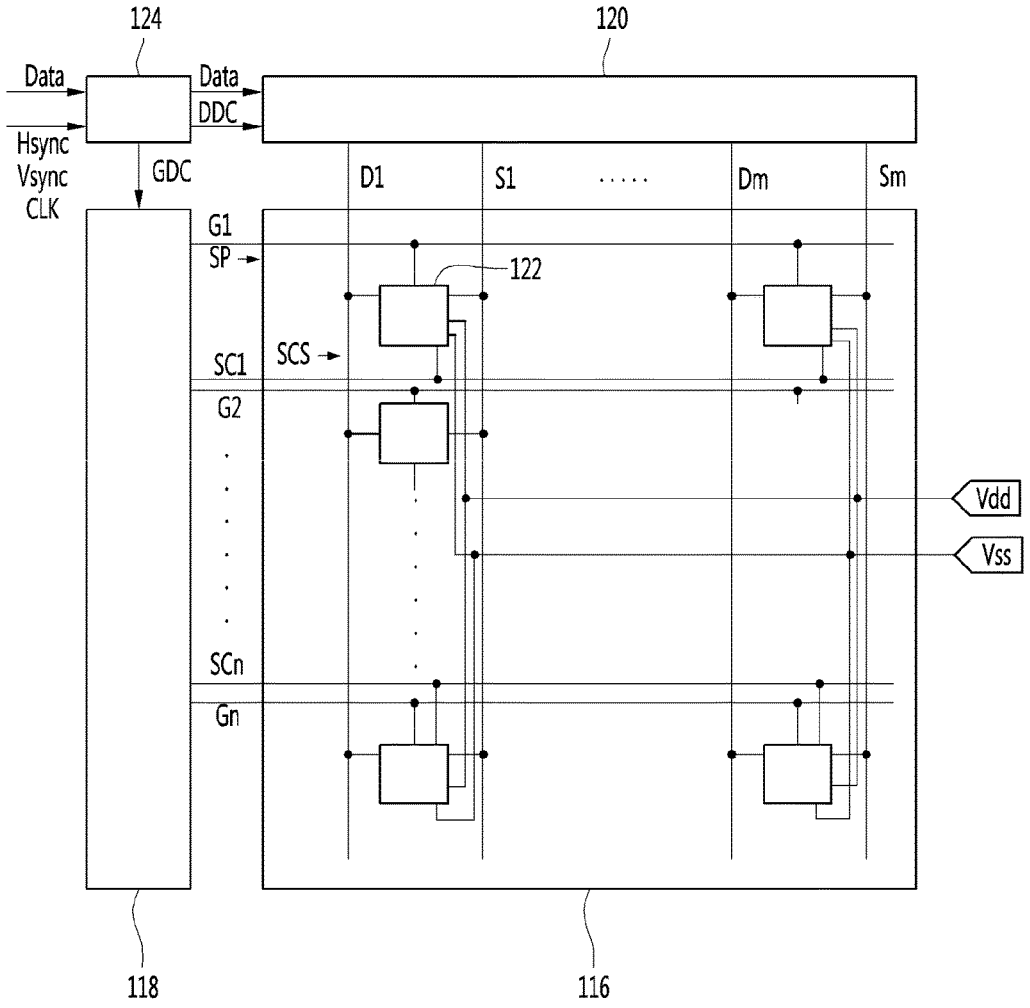
FIG. 3 is a block diagram showing an organic light emitting diode display device according to an embodiment of the present invention.

FIG. 3 is a block diagram showing an organic light emitting diode display device according to an embodiment of the present disclosure.

Referring to FIG. 3, an organic light emitting diode display device according to an embodiment of the present disclosure can include a display panel 116, a gate driver 118, a data driver 120 and a timing controller 124.

The display panel 116 can include m data lines D1~Dm, m sensing lines S1~Sm, n gate lines G1~Gn and n sensing control lines SC1~SCn and m×n pixels 122. The m data lines D1~Dm and the m sensing lines S1~Sm are opposite to each other one by one and form m pairs. Similarly, the n gate lines G1~Gm and the n sensing control lines SC1~SCn are opposite to each other one by one and form m pairs. Each of the pixels 122 can be formed in a region which is defined by crossing a pair of the data line D and the sensing line S and a pair of the gate line G and the sensing control line SC.

Also, signal lines used to apply a first driving voltage Vdd to each of the pixels 122 and signal lines used to apply a second driving voltage Vss to each of the pixels 122 can be formed on the display panel 116. The first driving voltage Vdd can be generated in a high potential driving voltage source Vdd. The second driving voltage Vss can be generated in a low potential driving voltage source Vss.

The gate driver 118 can generate scan pulses in response to gate control signals GDC from the timing controller 124. The scan pulses can be sequentially applied to the gate lines G1~Gn.

Also, the gate driver 118 can output sensing control signals SCS to the sensing control lines SC1~SCn under control of the timing controller 124. The sensing control signal SCS is used to control a sensing switch included in each of the pixels.

Although it is explained that the gate driver 118 outputs both of the scan pulses SP and the sensing control signals SCS, but the present disclosure is not limited to this. Alternatively, the organic light emitting diode display device can additionally include a sensing switch control driver which outputs the sensing control signals SCS under control of the timing controller 124.

The data driver 120 can be controlled by data control signals DDC applied from the timing controller 124. Also, the data driver 120 can apply data voltages to the data lines D1~Dm. Moreover, the data driver 120 can apply a sensing voltage to the sensing lines S1~Sm.

The data lines D1~Dm are connected to the pixels 122. As such, the data voltages can be transferred to the pixels 122 via the data lines D1~Dm.

The sensing lines S1~Sm are connected to the pixels 122. Such sensing lines S1~Sm can be used to not only apply the sensing voltage to the pixels 122 but also measure the sensing voltages. The sensing voltage can be obtained by charging an initialization voltage into the pixels through the respective sensing lines S and the entering the pixels in a floating state.

Although it is explained that the data driver 120 can output the data voltage and the sensing voltage and detect the sensing voltage, the present disclosure is not limited to this. Alternatively, the organic light emitting diode display device can additionally include a sensing driver which outputs the sensing voltage and detects the sensing voltage.

[Configuration of Pixel]

Figure 4:
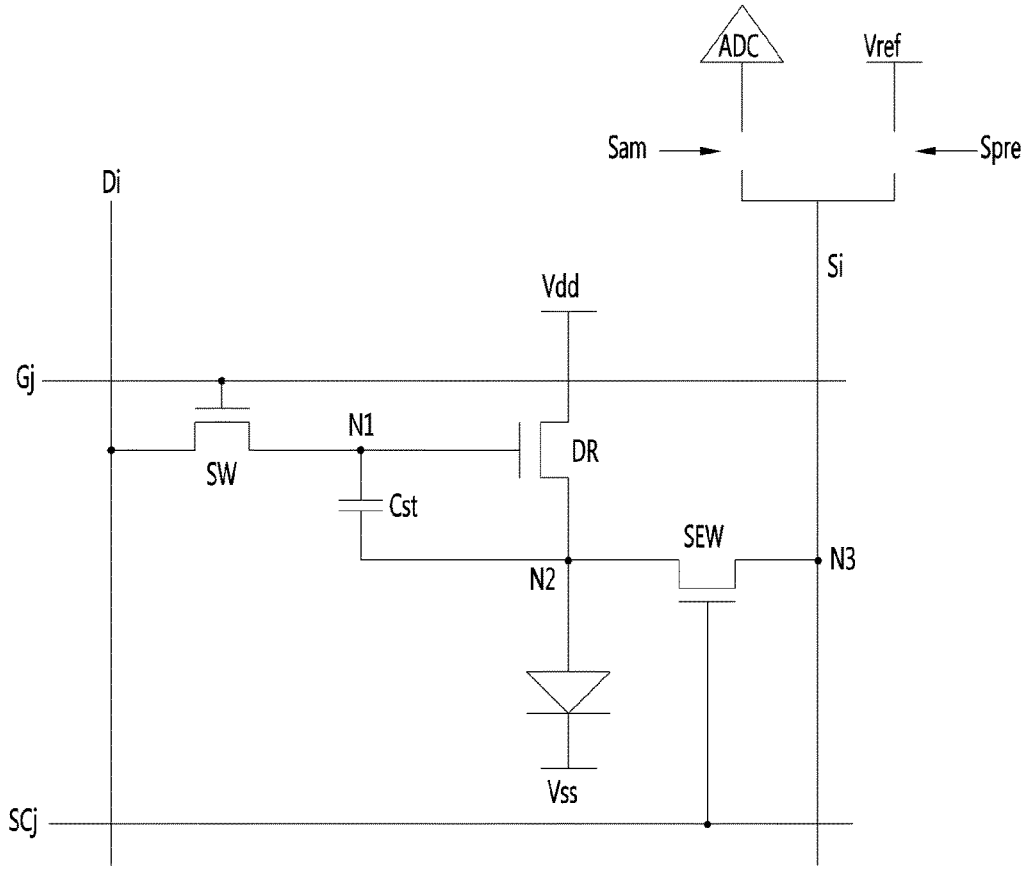
FIG. 4 is a circuit diagram showing the configuration of a single pixel according to an embodiment of the present invention.

FIG. 4 is a circuit diagram showing the configuration of a single pixel according to an embodiment of the present disclosure.

The pixel 122 introduced in the present disclosure can be one of red, green, blue and white pixels. The pixel 122 can be called a sub-pixel.

The pixel 122 can include a scan switch SW, a driving switch DR, a sensing switch SEW, an organic light emitting diode OLED and a storage capacitor Cst.

The scan switch SW can be controlled by a scan pulse SP on a gate line Gi. Also, the scan switch SW can be connected between a data line Di and a first node N1. Such a scan switch SW can be used to transfer a data voltage on the data line Di to the pixel 122.

The driving switch DR can be used to adjust a current flowing through an organic light emitting diode OLED on the basis of a voltage between the first node N1 and a second node N2 which are connected to gate and source electrodes of the driving switch DR. Such a driving switch DR can includes the gate electrode connected to the first node N1, the source connected to the second node N2, and a drain electrode connected to a first driving voltage source Vdd.

The sensing switch SEW can be used as a transistor for controlling an initialization of the second node N2 and a detection of the threshold voltage of the driving switch DR which are performed using the sensing line Si. Also, the sensing switch SEW can be controlled by a sensing control signal SCS on a sensing line SCj. Such a sensing switch SEW can be connected between the second node N2 and a third node N3.

An anode electrode of the organic light emitting diode OLED can be connected to the second node N2. A cathode electrode of the organic light emitting diode OLED can be connected to a second driving voltage line Vss.

The storage capacitor Cst can be connected between the first node N1 and the second N2. In other words, the storage capacitor Cst can be connected between the gate and source electrodes of the driving switch DR.

[Threshold Voltage Sensing Mode]

Figure 5:
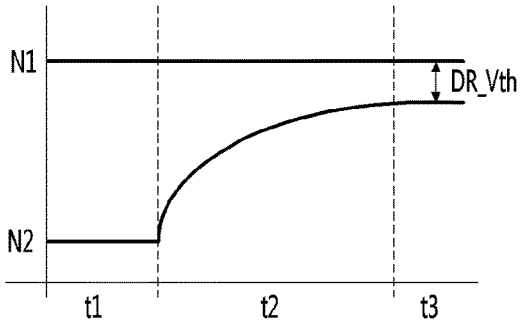
FIG. 5 is a waveform diagram showing voltage signals on the first and second nodes of FIG. 4 when a threshold voltage is sensed.
Figure 6:
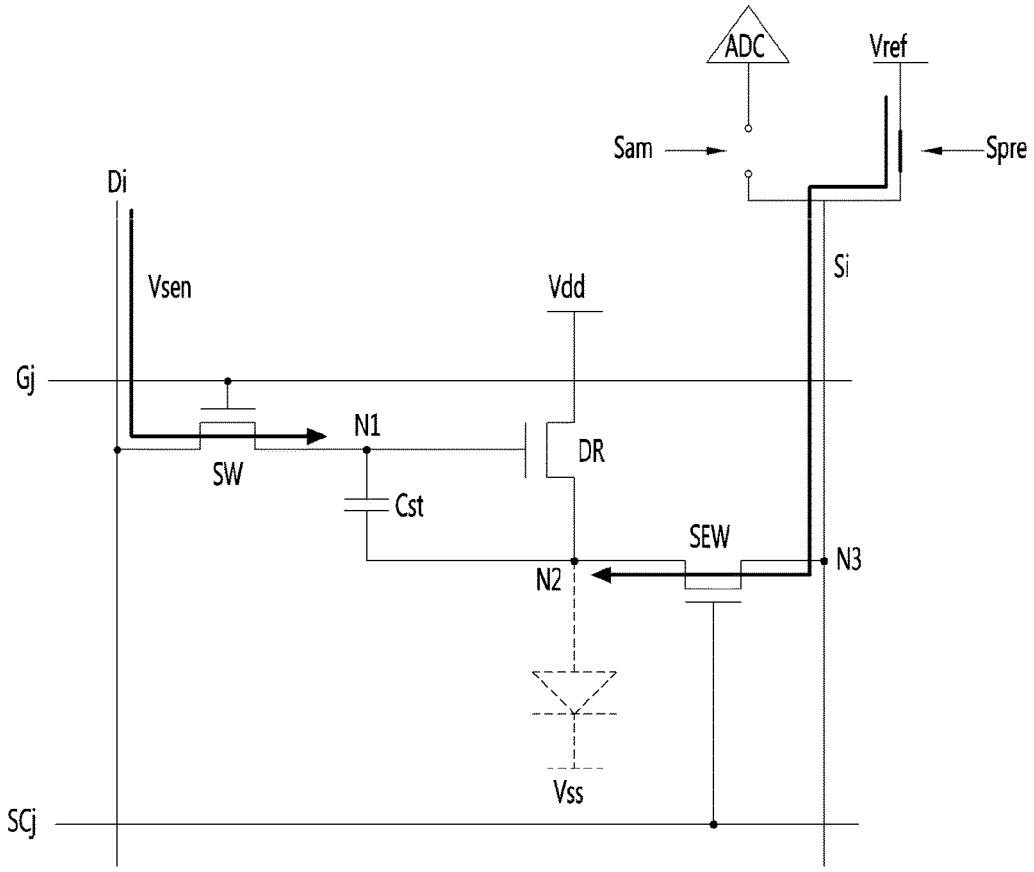
FIGS. 6 through 8 are circuit diagrams illustrating operation states of a pixel when a threshold voltage is sensed according to an embodiment of the present invention.
Figure 7:
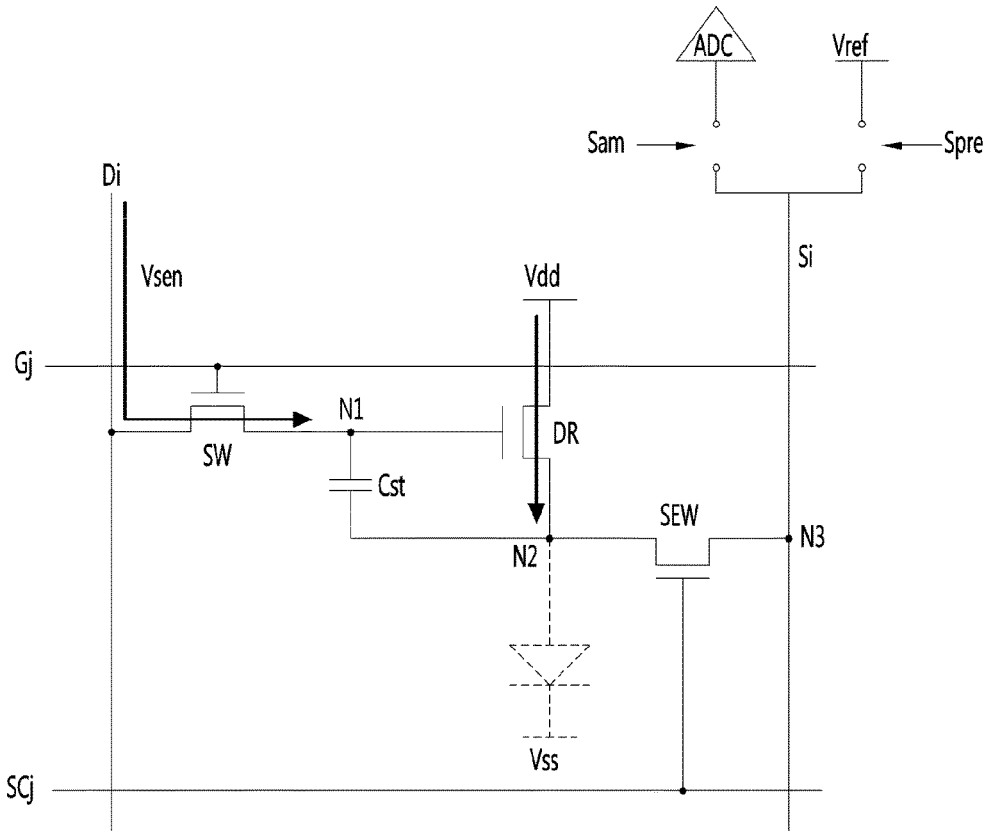
Figure 8:
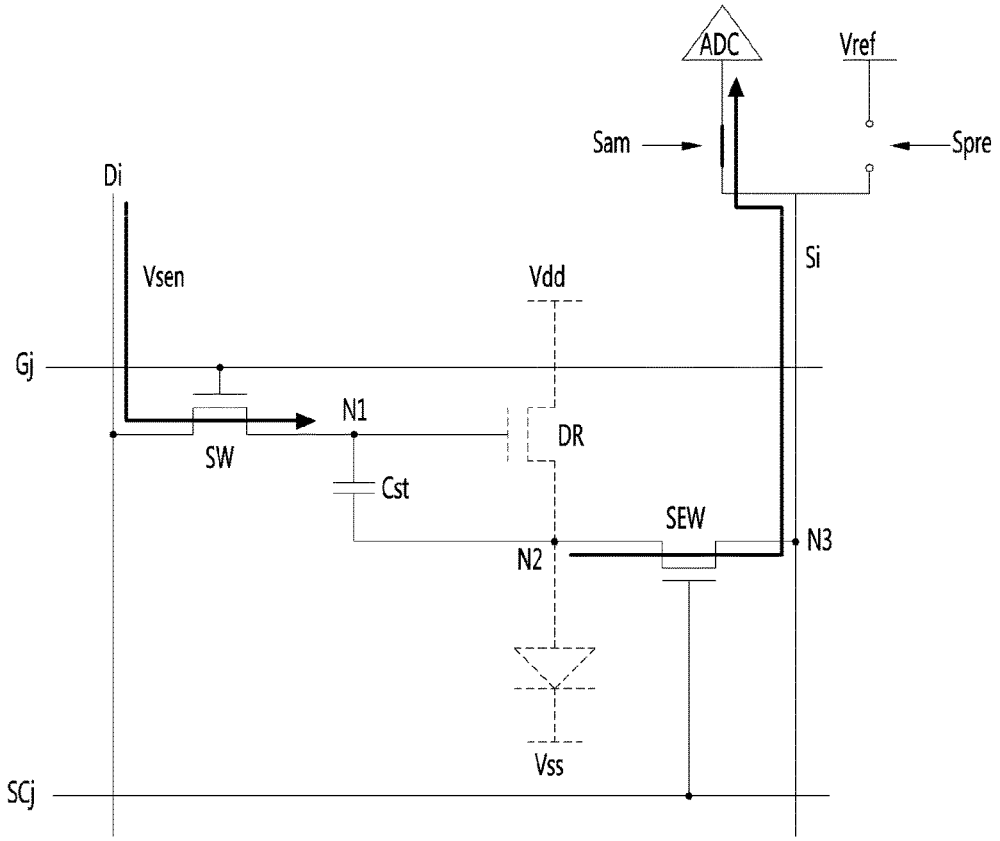

FIG. 5 is a waveform diagram showing voltage signals on the first and second nodes of FIG. 4 in the threshold voltage sensing mode. FIGS. 6 through 8 are circuit diagrams illustrating operation states of a pixel in a threshold voltage sensing mode.

[Initialization Interval t1]

Referring to FIGS. 5 and 6, the scan switch SW and the sensing switch SEW are turned-on in the initialization interval t1. Then, a sensing voltage Vsen on the data line Di is charged into the first node N1 through the scan switch SW. A reference voltage Vref controlled by a initialization control signal Spre is charged into the second node N2 via the sensing line Si and the sensing switch SW. As such, the storage capacitor Cst is initialized to be a voltage difference Vsen-Vref between the first and second nodes N1 and N2. Also, the organic light emitting diode OLED cannot emit light due to the reference voltage Vref which is applied to the second node N2 through the sensing switch SEW.

[Source-Follower Driving Interval t2]

Referring to FIGS. 5 and 7, during a source-follower driving interval t2, the sensing line Si is floated and the scan switch SW and the sensing switch SEW maintain the turned-on state. Then, a current flows through the driving switch DR, which uses the high potential voltage source Vdd as an energy source, by a stored voltage of the storage capacitor Cst (i.e., a voltage Vgs between the gate and source electrodes of the driving switch DR). The current flowing through the driving switch DR is charged in the second node N2 and gradually increases a voltage on the second node N2. As such, because the voltage between the gate and source electrodes of the driving switch DR is gradually lowered, the current flowing through the driving switch DR is gradually decreased. Also, when the voltage between the gate and source electrodes of the driving switch DR reaches the threshold voltage of the driving switch DR, the current flowing through the driving switch DR is intercepted. In accordance therewith, the voltage on the second node N2 is constantly maintained.

[Threshold Voltage Detecting Interval t3]

Referring to FIGS. 5 and 8, the sensing line Si is electrically connected to an analog-to-digital converter (hereinafter, "ADC") 250 by a sampling control signal Sam during a threshold voltage detecting interval t3. Then, the voltage on the second node N2 is detected as a threshold voltage and converted into a digital signal shape. The detected threshold voltage Vth is used to generate a compensation data signal Vd which is applied to the data line Di in a driving switch property compensating and organic light emitting diode property sensing mode. As such, the threshold voltage Vth of the driving switch DR can be compensated.

[Driving Switch Property Compensating and Organic Light Emitting Diode Sensing Mode]

Figure 9A:
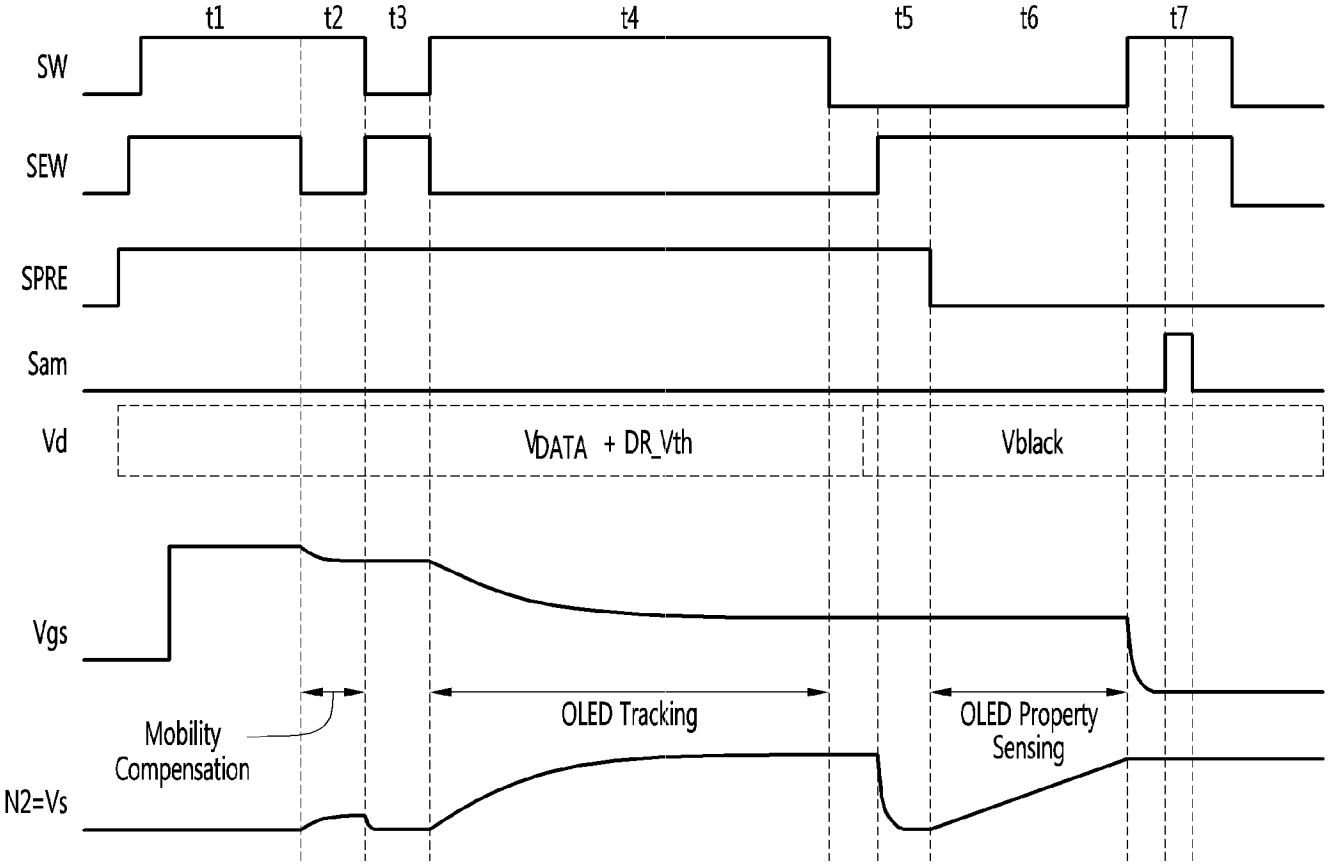
FIG. 9A is a waveform diagram showing signals which are input to and generated in the pixel during a driving switch property compensating and an organic light emitting diode property sensing mode according to an embodiment of the present invention.

FIG. 9A is a waveform diagram showing signals which is input to and generated in the pixel during a driving switch property compensating and an organic light emitting diode property sensing mode. FIGS. 10 through 14 and FIGS. 16 through 18 are circuit diagrams illustrating operation states of a pixel in a driving switch property compensating and organic light emitting diode property sensing mode.

[First Initialization Interval t1]

Figure 10:
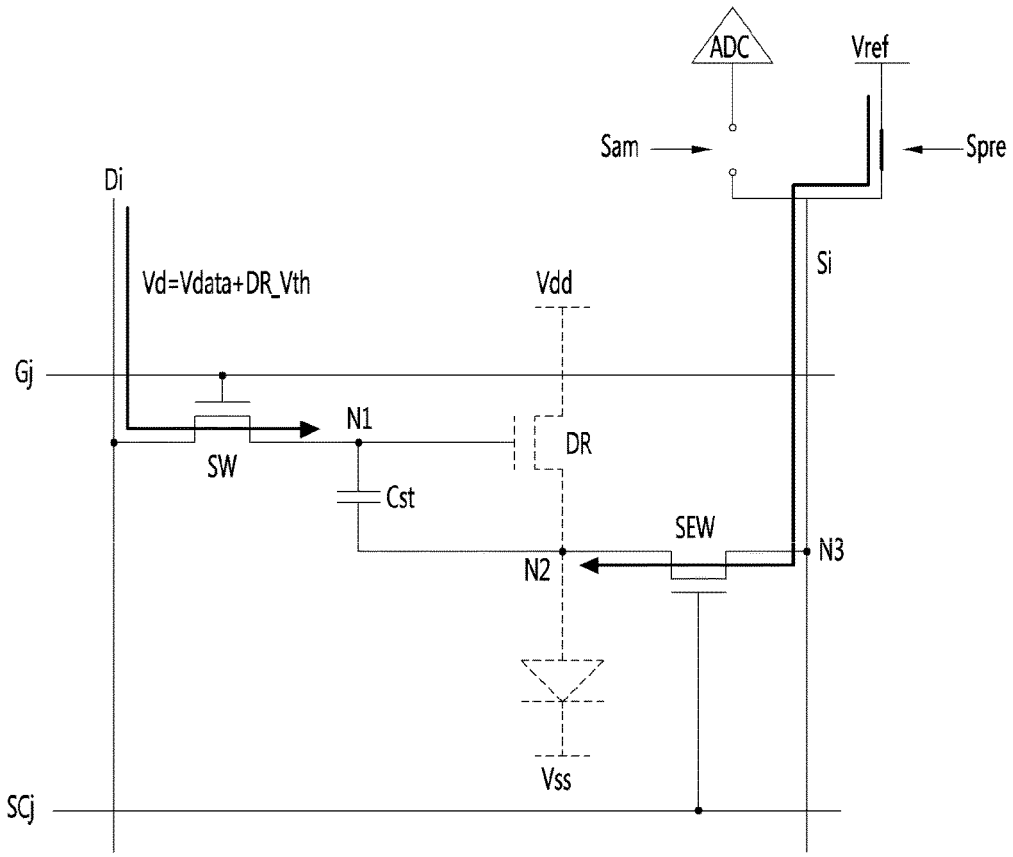
FIG. 10 is a circuit diagram illustrating an operation state of a pixel in a first initialization interval according to example embodiment of the present invention.

FIG. 10 is a circuit diagram illustrating an operation state of a pixel in a first initialization interval.

Referring to 9A and 10, the scan switch SW and the sensing switch SEW are turned-on in a first initialization interval t. Then, the compensation data voltage Vd on the data line Di is charged to the first node N1 through the scan switch SW. Also, the reference voltage Vref controlled by the initialization control signal Spre is charged into the second node N2 through the sensing line Si and the sensing switch SEW. Moreover, the storage capacitor Cst is initialized by a voltage difference Vd−Vref. The reference voltage Vref applied to the second node N2 forces the organic light emitting diode OLED not to emit light. The compensation data voltage Vd becomes a sum of a data voltage Vdata and the threshold voltage DR_Vth of the driving switch DR.

[Driving Switch Property Compensating Interval t2]

Figure 11:
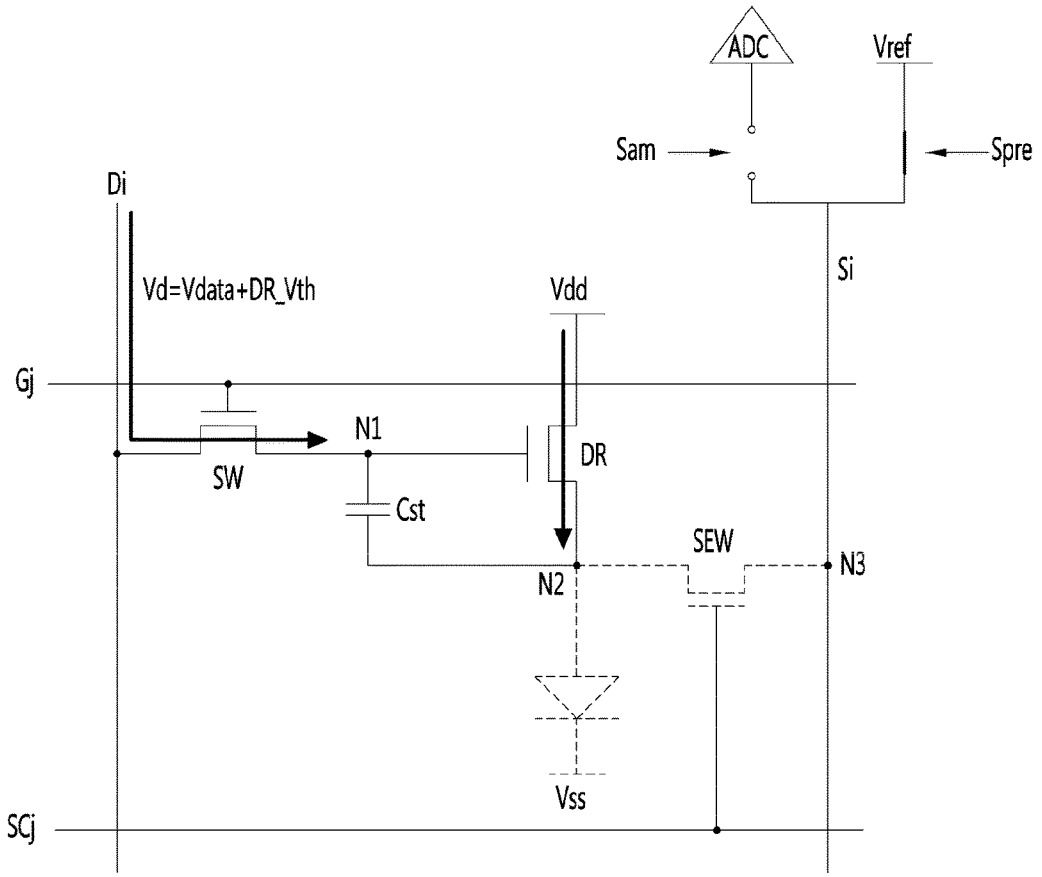
FIG. 11 is a circuit diagram illustrating an operation state of a pixel in a driving switch property compensating interval according to an example of the present invention.

FIG. 11 is a circuit diagram illustrating an operation state of a pixel in a driving switch property compensating interval.

Referring to FIGS. 9A and 11, during a driving switch property compensating interval t2, the scan switch SW maintains the turned-on state but the sensing switch SEW is turned-off. Then, a driving current flows through the driving switch DR by the voltage Vd−Vref of the storage capacitor Cst and enables the second node N2 to be charged with a voltage. A charging speed of the voltage at the second node N2 depends on a mobility property of the driving switch DR. If the driving switch DR has a superior mobility property, the voltage on the second node N2 is steeply increased because the current flowing through the driving switch DR becomes greater. On the contrary, when the driving switch DR has an inferior mobility property, the voltage on the second node N2 is gently increased because the current flowing through the driving switch DR becomes smaller. In other words, an increase width of the voltage depends on the mobility property of the driving switch DR. As such, a decrease degree of the voltage stored in the storage capacitor Cst, i.e., a decrease degree of a voltage Vgs between the gate and source electrodes of the driving switch DR also depends on the mobility property of the driving switch DR. In this manner, as the increase width of the voltage on the second node N2 depends on the property of the driving switch Dr, the property of the driving switch DR can be reflected to the gate-source voltage Vgs (i.e., the voltage Vgs between the gate and source electrodes of the driving switch DR). In accordance therewith, the mobility property of the driving switch DR can be compensated.

[Second Initialization Interval t3]

Figure 12:
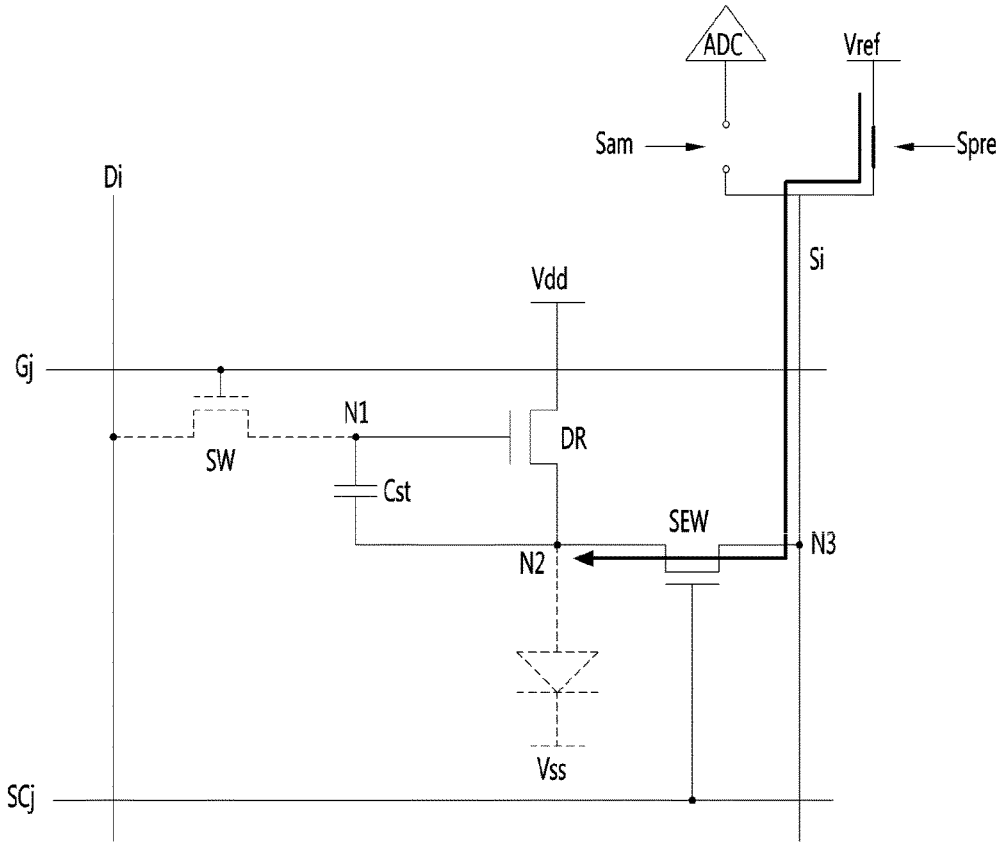
FIG. 12 is a circuit diagram illustrating an operation state of a pixel in a second initialization interval according to an example of the present invention.

FIG. 12 is a circuit diagram illustrating an operation state of a pixel in a second initialization interval.

Referring to FIGS. 9A and 12, during a second initialization interval t3, the scan switch SW is turned-off but the sensing switch SEW is turned-on. Then, the reference voltage Vref is charged into the second node N2 via the sensing line Si and the sensing switch SEW. As such, the voltage on the first node N1 is decreased by a decrease width of the voltage on the second node N2 due to a coupling effect of the storage capacitor Cst. In accordance therewith, the gate-source voltage Vgs of the driving switch DR is maintained without any variation. On the other hand, the organic light emitting diode OLED does not emit light by the reference voltage Vref which is applied to second N2 through the sensing switch SEW.

[Organic Light Emitting Diode Property Tracking Interval t4]

Figure 13:
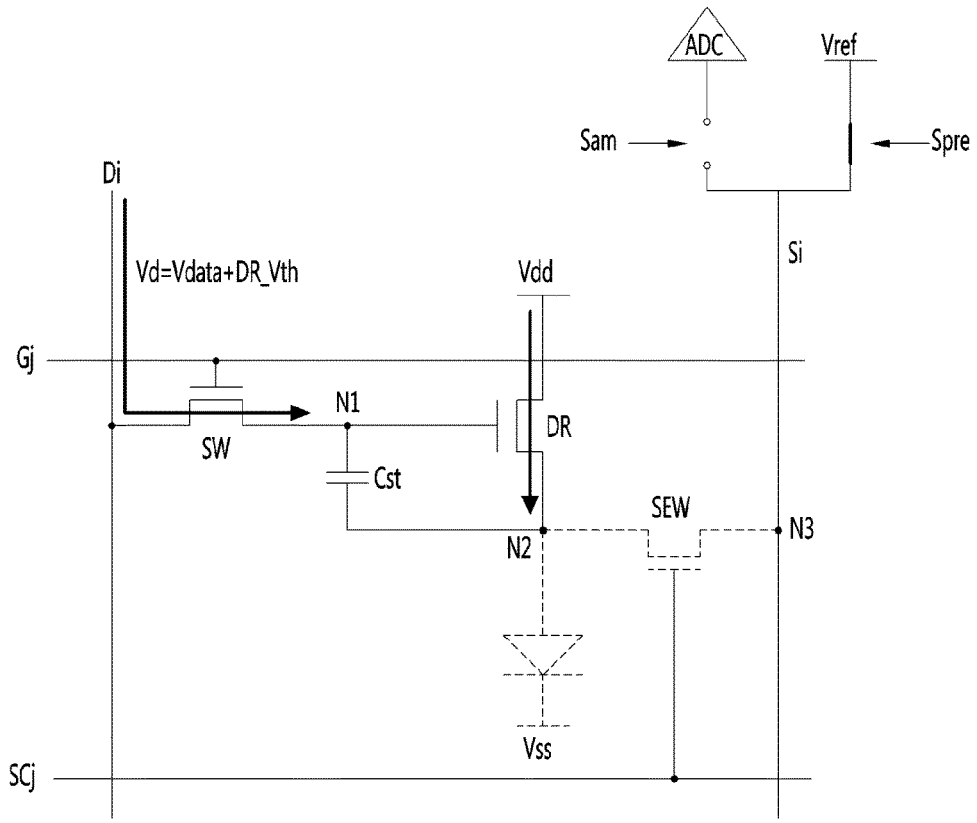
FIGS. 13 and 14 are circuit diagrams showing operation states of a pixel in an organic light emitting diode property tracking interval according to an example of the present invention.
Figure 14:
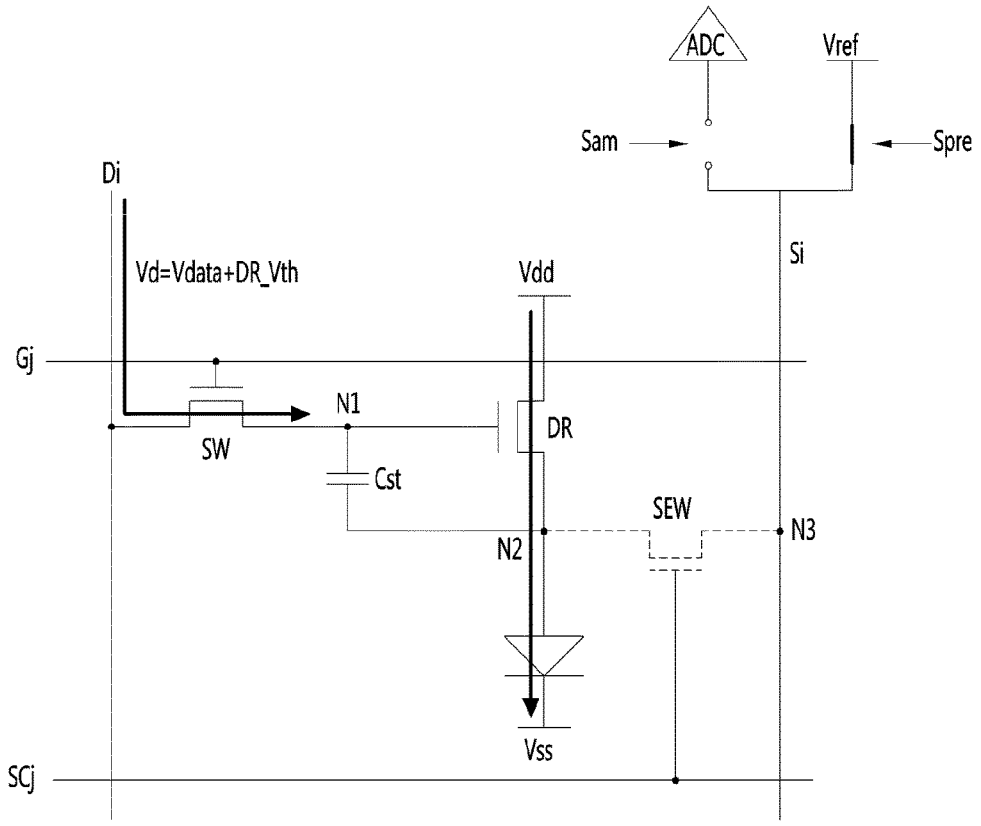
Figure 15:
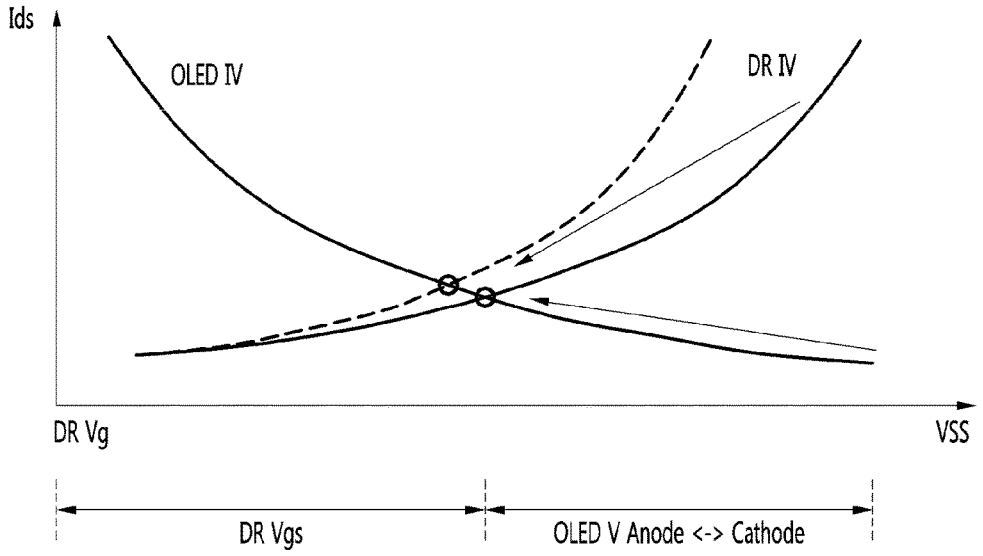
FIG. 15 is a data sheet illustrating current-to-voltage properties of an organic light emitting diode and a driving switch according to an example of the present invention.

FIGS. 13 and 14 are circuit diagrams showing operation states of a pixel in an organic light emitting diode property tracking interval t4. FIG. 15 is a data sheet illustrating current-to-voltage properties of an organic light emitting diode and a driving switch.

Referring to FIGS. 9A, 13, 14 and 15, during an organic light emitting diode property tracking interval t4, the scan switch SW is turned-on but the sensing switch SEW is turned-off. Then, the compensation data voltage Vd on the data line Di is transferred to the first node N1 via the scan switch SW and enables a current to flow through the driving switch DR which is driven in a source follower mode, as shown in FIG. 13. The current flowing through the driving switch DR enables not only a voltage to be charged into the second node N2 but also the gate-source voltage Vgs of the driving switch DR to be decreased by the increasing voltage of the second node N2. When the voltage on the second node N2 reaches an operation voltage (or a threshold voltage) of the organic light emitting diode OLED, the organic light emitting diode OLED is turned and emits light because of a current flows through the organic light emitting diode OLED, as shown in FIG. 14. As such, the voltage on the second node N2 is constantly maintained and furthermore the gate-source voltage Vgs is constantly maintained.

At this time, the voltage developed on the second node N2 depends on the gate-source voltage Vgs of the driving switch DR. As shown in FIG. 15, the current DR_IV flowing through the driving switch DR being driven in the source follower mode becomes gradually smaller along the increment of the voltage on the second node N2, but the current OLED_IV flowing through the organic light emitting diode OLED becomes gradually larger along the increment of the voltage on the second node N2. In other words, the current OLED_IV flowing through the organic light emitting diode OLED is varied reciprocally with the current DR_IV flowing through the driving switch DR. As such, the operation voltage Voled of the organic light emitting diode OLED can be tracked. As such, the gate-source voltage Vgs of the driving switch DR can have a value reflecting the operation voltage Voled of the organic light emitting diode OLED. In other words, the operation voltage Voled of the organic light emitting diode OLED is reflected to the gate-source voltage Vgs of the driving switch DR. Also, the deterioration property of the organic light emitting diode OLED can increase not only the threshold voltage of the organic light emitting diode OLED but also the operation voltage Voled of the organic light emitting diode OLED. Due to this, the gate-source voltage Vgs of the driving switch DR must be more lowered. Moreover, the deterioration property of the driving switch DR forces a property of the driving current DR_IV flowing through the driving switch DR to be varied from a current property indicated by a dot line or a solid line toward another current property indicated by the solid line or the dot line as shown in FIG. 15. As such, the gate-source voltage of the driving switch DR allowing the current DR_IV flowing through the driving switch DR to be the same as the current OLED_IV flowing through the organic light emitting diode OLED must be varied. In accordance therewith, the deterioration property of the driving switch DR can be reflected to the gate-source voltage Vgs of the driving switch DR. However, because the deterioration property of the driving switch DR is previously compensated in the above-mentioned driving switch property compensating interval t2, the deterioration property of the driving switch DR being reflected to the gate-source voltage Vgs of the driving switch DR can be minimized in the organic light emitting diode property tracking interval t4. Therefore, the properties of the organic light emitting diode OLED can be maximally reflected to the gate-source voltage Vgs of the driving switch DR during the organic light emitting diode tracking interval t4.

The organic light emitting diode property tracking interval t4 can be adjusted (or reduced). As such, the third initialization interval t5 can start before the organic light emitting diode OLED is turned-on. In other words, the second node N2 can be initialized in the third initialization interval t5 starting before the current flowing through the driving switch DR and the current flowing through the organic light emitting diode OLED become the same as each other. Nevertheless, the properties of the organic light emitting diode OLED is continuously reflected to the gate-source voltage Vgs of the driving switch DR while the current flowing through the driving switch DR and the current flowing through the organic light emitting diode OLED are reciprocally varied until the same. As such, the properties of the organic light emitting diode OLED can be sufficiently reflected to the gate-source voltage Vgs of the driving switch DR even though the organic light emitting diode property tracking interval t5 is not maintained until the organic light emitting diode OLED is turned-on.

In accordance therewith, the organic light emitting diode property tracking interval t4 can be properly adjusted in a time range which reflects the property of the organic light emitting diode OLED maximally larger than that of the driving switch DR. In this case, a gate pulse modulation method is used in the generation of a scan pulse. As such, a center portion and an edge portion of the display panel 116 which have different loads from each other, can be matched in timing.

Figure 9B:
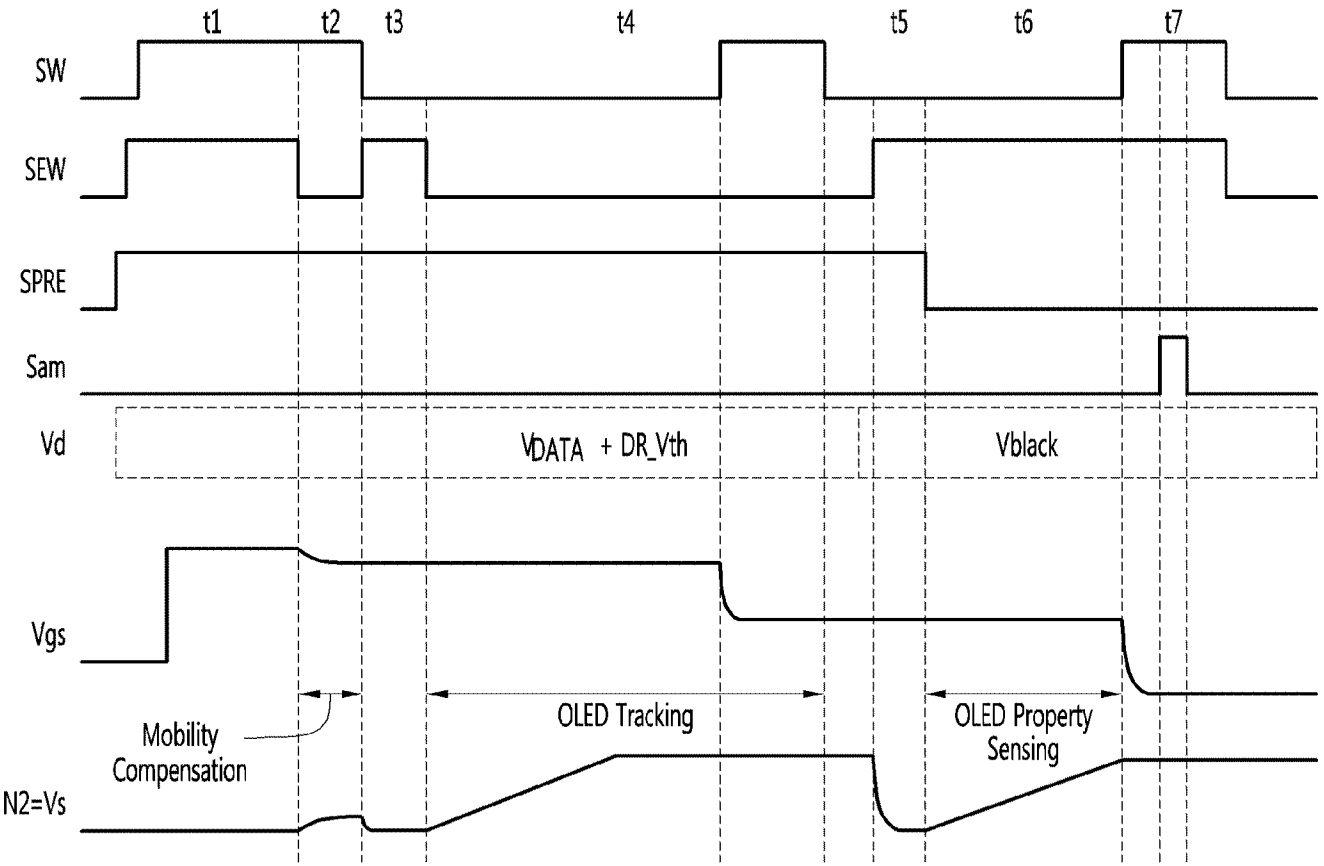
FIG. 9B is another waveform diagram showing signals which are input to and generated in the pixel during a driving switch property compensating and an organic light emitting diode property sensing mode according to an embodiment of the present invention.

FIG. 9B is another waveform diagram showing signals which is input to and generated in the pixel during a driving switch property compensating and an organic light emitting diode property sensing mode.

Referring to FIG. 9B, during the organic light emitting diode property tracking interval t5, the scan switch SW maintains the turned-off state and is turned-on only in a part of the organic light emitting diode property tracking interval t4 before the third initialization interval t5, unlike the scan switch SW continuously maintaining the turned-on state throughout the organic light emitting diode property tracking interval t5 as shown in FIG. 9A. The sensing switch SEW is turned-off in the organic light emitting diode property tracking interval t5. At this time, although the voltage on one of the first and second nodes N1 and N2 is varied, the gate-source voltage Vgs of the driving switch DR is constantly maintained without any variation because the voltage on the other node is varied by the coupling effect of the storage capacitor Cst. The driving switch DR is driven in a constant current mode by the constantly maintained gate-source voltage Vgs. The current applied from the driving switch DR is charged into the second node N2 and increases the voltage on the second node N2. The voltage on the second node N2 reaches the operation voltage of the organic light emitting diode OLED, the organic light emitting diode is turned-on and emits light corresponding to a current quantity flowing therethrough. Also, the voltage on the second node is constantly maintained.

Thereafter, the scan switch SW is turned before the third initialization interval t5 and transfers the compensation data voltage Vd on the data line Di to the first node Ni. As such, the deterioration property of the organic light emitting diode OLED can be reflected to the gate-source voltage Vgs of the driving switch DR. Similarly to the source follower mode of FIG. 9A, this constant current mode can enable the deterioration property of the organic light emitting diode OLED to be reflected to the gate-source voltage Vgs of the driving switch DR.

[Third Initialization Interval t1]

Figure 16:
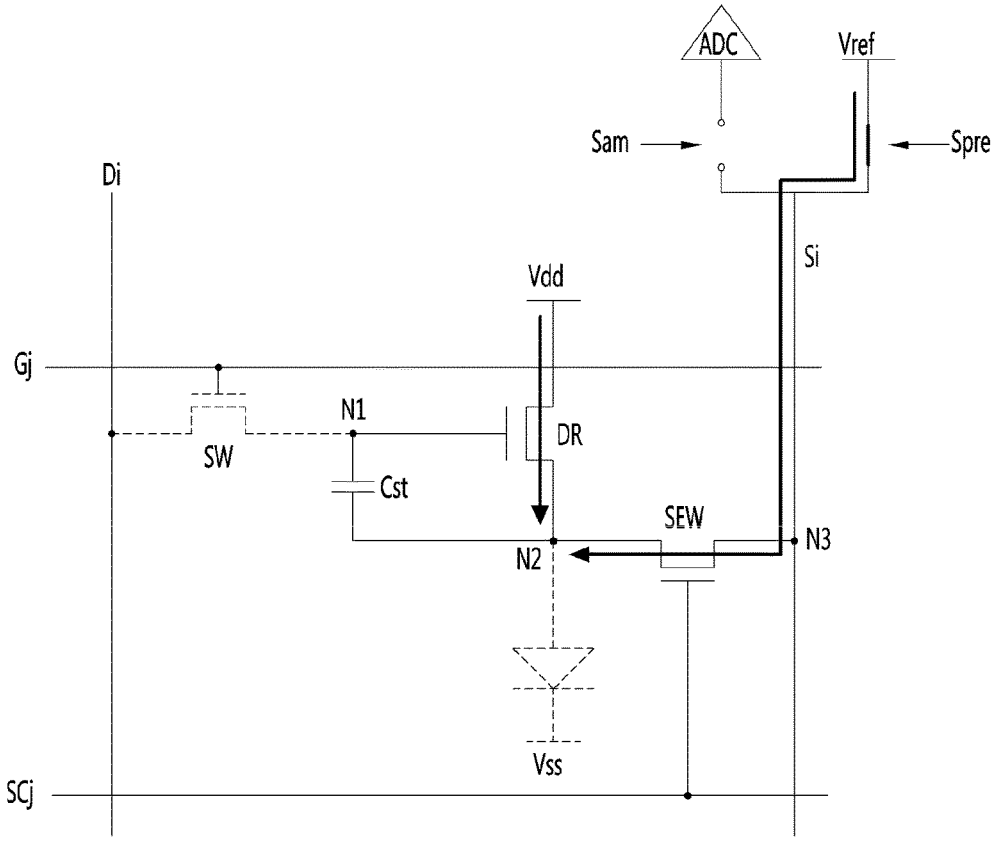
FIG. 16 is a circuit diagram illustrating an operation state of a pixel in a third initialization interval according to an example of the present invention.

FIG. 16 is a circuit diagram illustrating an operation state of a pixel in a third initialization interval.

Referring to FIGS. 9A and 16, during a third initialization interval t6, the scan switch SW is turned-off but the sensing switch SEW is turned-on. Also, the reference voltage Vref controlled by the initialization control signal Spre is charged into the second node N2 via the sensing line Si and the sensing switch SEW. Then, the voltage on the first node N1 is decreased by a decrease width of the voltage on the second node N2 due to the coupling effect of the storage capacitor. As such, the gate-source voltage Vgs of the driving switch DR is constantly maintained without any variation. Also, the operation voltage Voled stored in the storage capacitor Cst. Moreover, the reference voltage Vref applied to the second node N2 via the sensing switch SEW forces the organic light emitting diode OLED not to emit light.

In this manner, the second node N2 is initialized during the third initialization interval t5. As such, the gate-source voltage Vgs is reflected to the voltage on the second node N2. In accordance therewith, the gate-source voltage Vgs can be easily detected through a sensing process of the second node N2 which will be described later.

[Organic Light Emitting Diode Property Sensing Interval t6]

Figure 17:
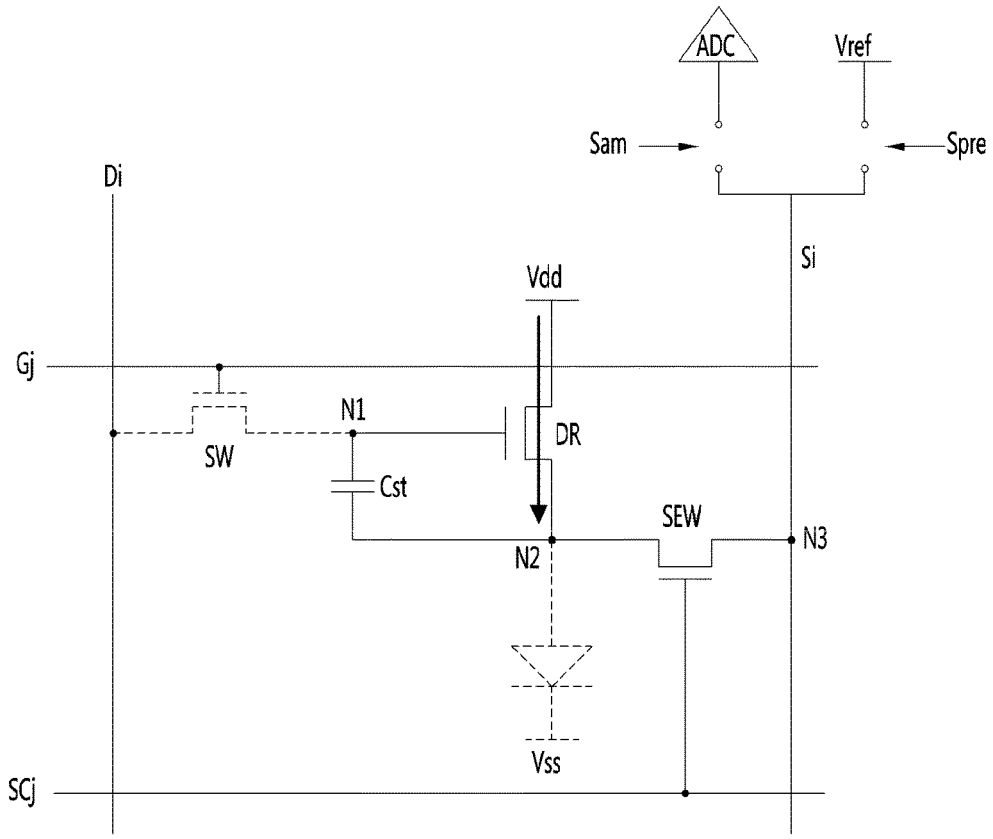
FIG. 17 is a circuit diagram illustrating an operation state of a pixel in an organic light emitting diode property sensing interval according to an example of the present invention.

FIG. 17 is a circuit diagram illustrating an operation state of a pixel in a organic light emitting diode property sensing interval.

Referring to FIGS. 9A and 17, during an organic light emitting diode property sensing interval t6, the scan switch SW maintains the turned-off state and the sensing switch SEW maintains the turned-on state. Also, the sensing line Si is disconnected from a line, which is used to transfer the reference voltage Vref, in response to the initialization control signal Spre and enters a floating state. Then, the voltage of the second node N2 is increased by the current flowing through the driving switch DR and the voltage on the first node N1 is also varied by a variation width of the voltage on the second node N2. As such, not only the gate-source voltage Vgs of the driving switch DR is constantly maintained but also the operation voltage Voled of the organic light emitting diode OLED stored in the storage capacitor Cst is maintained as it is. The current flowing through the driving switch DR depends on the operation voltage Voled of the organic light emitting diode OLED stored in the storage capacitor Cst and the increase width of the voltage on the second node N2 also depends on the current flowing through the driving switch DR. In accordance therewith, the operation voltage Voled of the organic light emitting diode OLED is reflected to the voltage of the second node N2.

[Organic Light Emitting Diode Property Detecting Interval t7]

Figure 18:
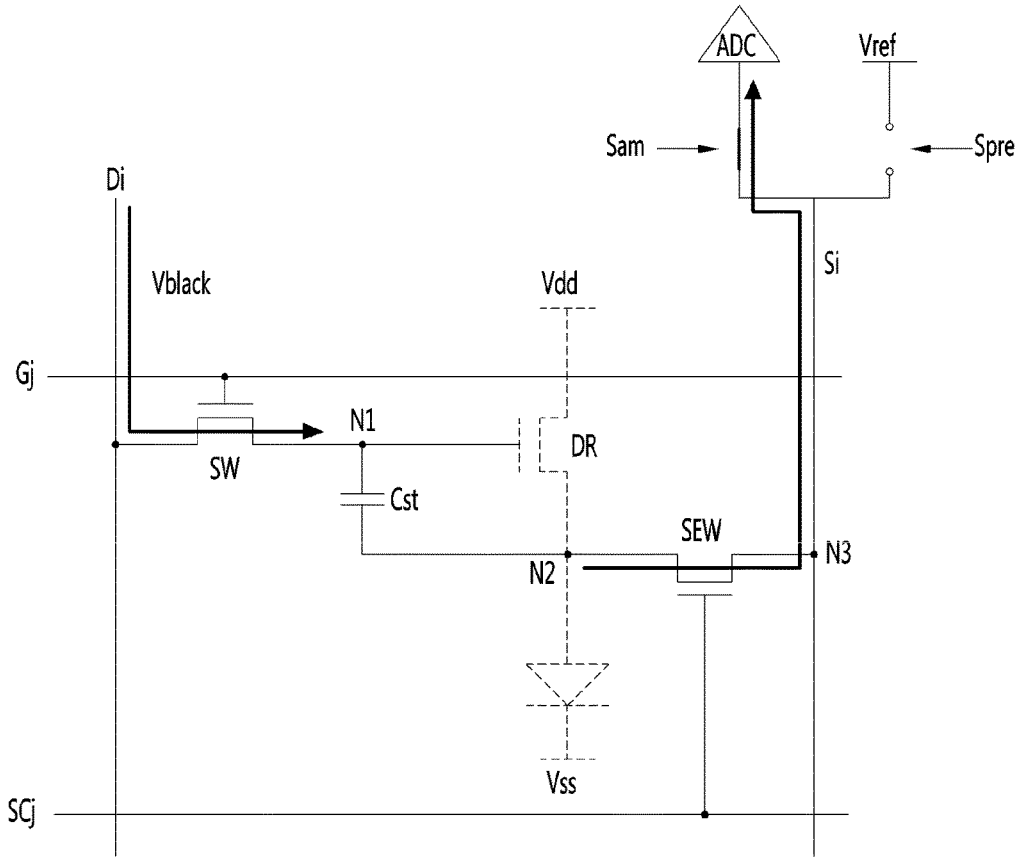
FIG. 18 is a circuit diagram illustrating an operation state of a pixel in an organic light emitting diode property detecting interval according to an example of the present invention.

FIG. 18 is a circuit diagram illustrating an operation state of a pixel in an organic light emitting diode property detecting interval.

Referring to FIGS. 9A and 18, the scan switch SW is turned-on and the sensing switch SEW maintains the turn-on state, in an organic light emitting diode property detecting interval t7. Also, a black data voltage Vblack on the data line Di is transferred to the first node N1 through the scan switch SW and enables the current flowing through the driving switch DR to be intercepted. Although the voltage on the first node N1 is decreased by being receiving the black data voltage Vblack, the coupling effect of the storage capacitor Cst is not reflected to the voltage on the second node N2 because the capacitance component of the sensing line Si have a relatively very lager capacitance compared to that of the storage capacitor Cst. As such, the voltage on the second node N2 can be stably maintained without any variation. Moreover, the ADC 250 controlled by the sampling control signal Sam and connected to the sensing line Si converts the voltage on the second node N2 into a digital signal shape. In accordance therewith, the voltage on the second node N2 can be detected. Therefore, the property of the organic light emitting diode can be detected.

In this manner, a deterioration property of the organic light emitting diode OLED can be detected using the above-mentioned external compensation method. Also, the deterioration property of the organic light emitting diode OLED can be compensated by reflecting the detected deterioration property of the organic light emitting diode OLED to the date voltage.

The process of sensing the property of the organic light emitting diode OLED is affected by external factors such as a temperature and so on. Due to this, although the operation voltage Voled of the organic light emitting diode OLED is reflected to the process of sensing the property of the organic light emitting diode OLED, it can be caused a problem by a variation of the mobility of the driving switch DR. However, the driving method of the organic light emitting diode display device can alleviate the mobility component of the driving switch and obtain a sensing value sufficiently reflecting the operation voltage Voled of the organic light emitting diode OLED. As such, sensing quality can be enhanced. Also, the driving method of the organic light emitting diode display device is not necessary for an additional memory which is used to sense the mobility property of the driving switch DR because it is internally compensated the mobility property. In accordance therewith, the number of memories can be reduced.

[Internal Configuration of Data Driver]

Figure 19:
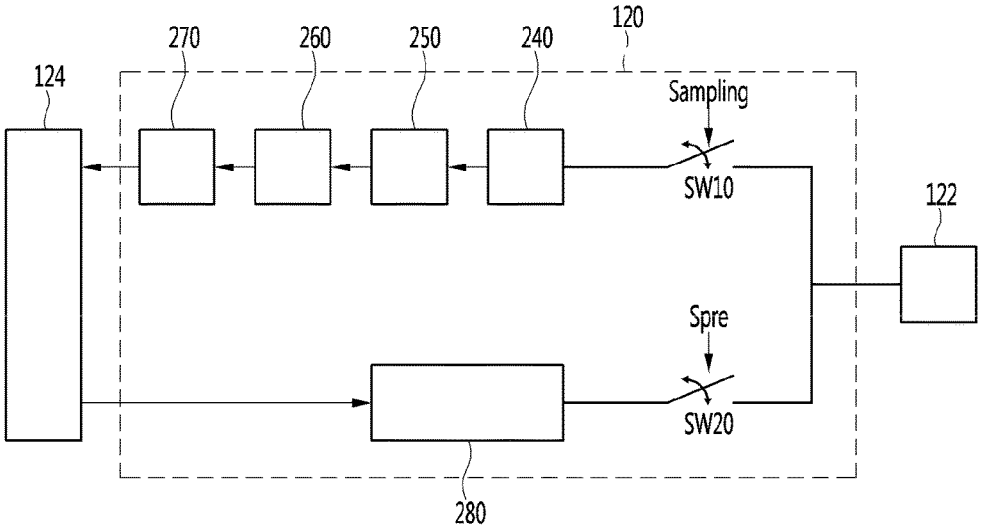
FIG. 19 is a detailed block diagram showing a part configuration of a data driver according to an embodiment of the present invention.

FIG. 19 is a detailed block diagram showing a part configuration of a data driver according to an embodiment of the present disclosure.

Referring to FIG. 12, the data driver 120 can include a sampling switch SW10 used for sampling sensing voltages and an initialization switch SW20 used for applying an initialization voltage. Also, the data driver 120 can include a sensing circuit 240, an analog-to-digital converter (ADC) 250 and a reference voltage generator 280.

The initialization switch SW20 can be turned-on in response to the initialization control signal Spre during a first initialization interval t1 of the threshold voltage detecting mode and first through third initialization intervals t1 through t3 of the driving switch property compensating and organic light emitting diode property sensing mode. The turned-on initialization switch SW20 can transfer the reference voltage Vref applied from the reference voltage generator 280 to a pixel 122.

The initialization control signal Spre used to control the initialization switch SW20 can be applied from the timing controller 124.

The sampling switch SW10 can be turned-on by a sampling signal Sam with a high level during the threshold voltage detection interval t3 of the threshold voltage detecting interval t3 of the threshold voltage sensing mode and the organic light emitting diode property detecting interval t7 of the driving switch property compensating and organic light emitting diode property sensing mode. The turned-on sampling switch SW10 enables the sensing circuit 240 to sense (or detect) sensing voltages on sensing lines S1~Sm.

The sampling signal Sampling used for controlling the sampling switch SW10 can be applied from the timing controller 124.

Meanwhile, the sampling switch SW10 and the initialization switch SW20 can be turned-off by the sampling signal Sam and the initialization control signal Spre which each have a low level. As such, the sensing lines S1~Sm can become a floating state.

The ADC 250 can convert the sensing voltages, which are detected from the sensing lines S1~Sm by the sensing circuit 240, into digital sensing values. The converted digital sensing values can be applied to the timing controller 124. The ADC 250 can be configured in a separated manner from the sensing circuit 240. Alternatively, the ADC 240 can be configured in a single body united with the sensing circuit 240 by being built in the sensing circuit 240.

[Sensing Data Transfer Method]

A data transfer method of transfer sensing data, which includes the threshold voltage of the driving switch DR and the operation voltage Voled of the organic light emitting diode OLED, from the sensing circuit 240 to the timing controller 124 will now be described.

Figure 20:
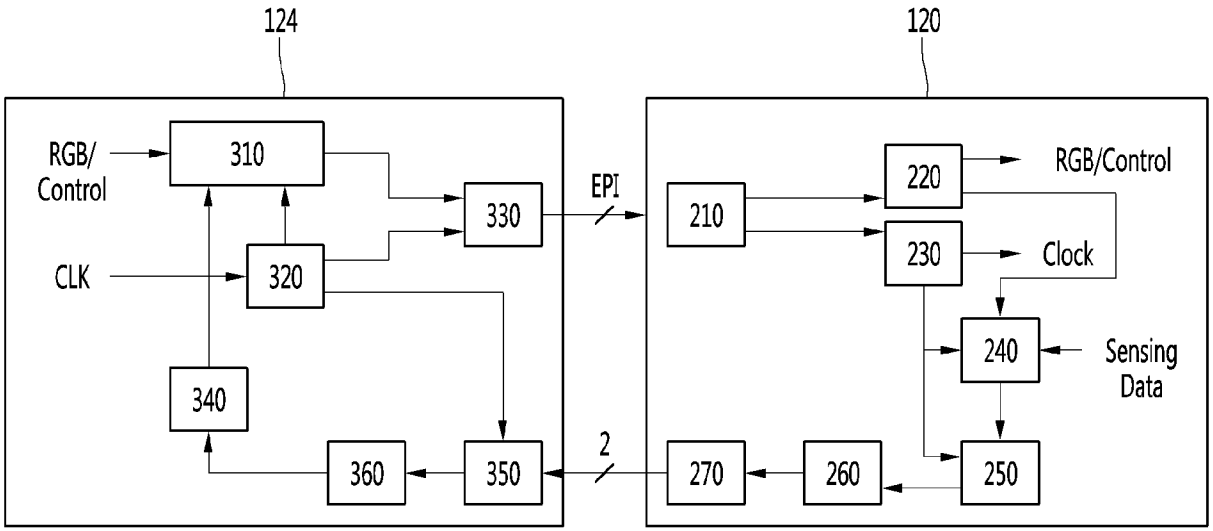
FIGS. 20 and 21 are detailed block diagrams showing the timing controller and the data driver in FIG. 4 according to an embodiment of the present invention.
Figure 21:
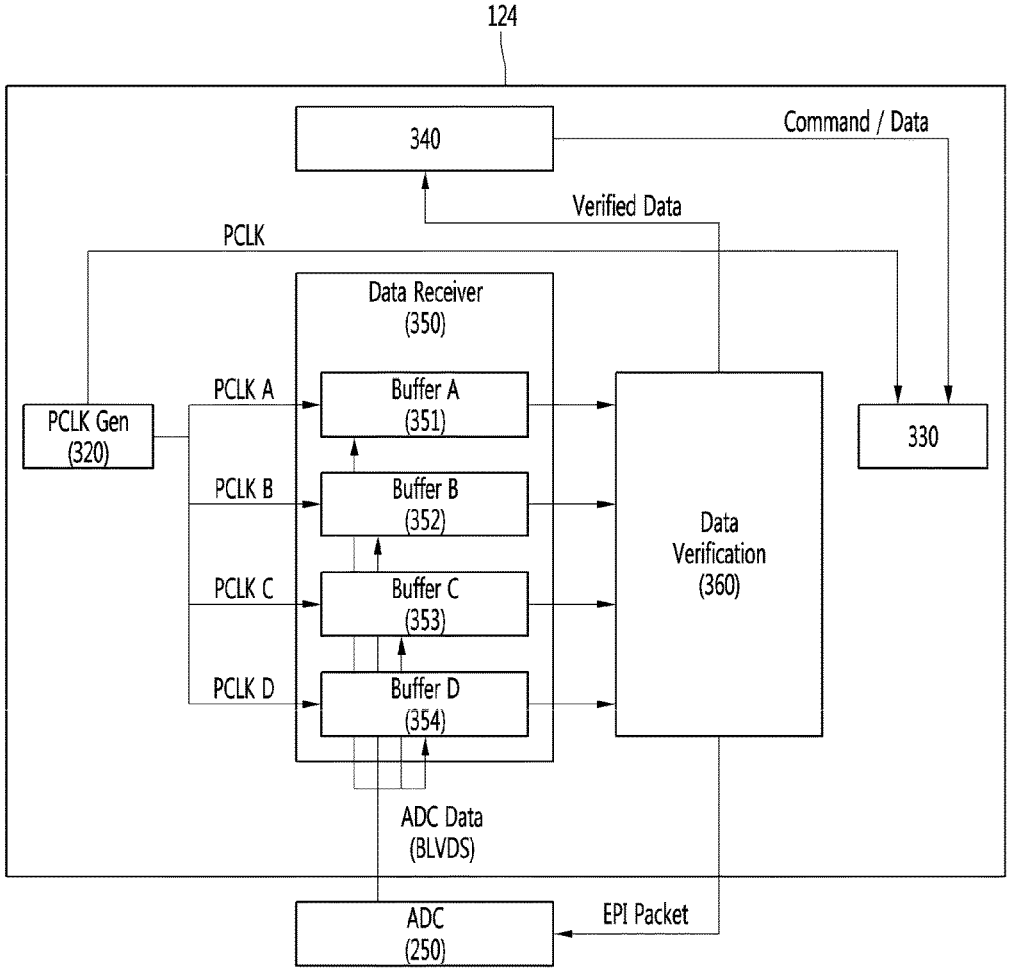
Figure 22:
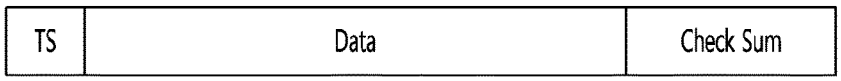
FIG. 22 is a diagram showing a sensing data packet according to an embodiment of the present invention.

FIG. 20 is a detailed block diagram showing the timing controller and the data driver in FIG. 4. FIG. 21 is a detailed block diagram showing the timing controller in FIG. 4. FIG. 22 is a diagram showing a sensing data packet. FIGS. 23A, 23B, 23C and 23D are diagrams illustrating a receiving and processing method of sensing data which is performed by the timing controller.

Referring to FIGS. 20 through 23D, the timing controller 124 can include a first serializer 310, an internal clock generator 320, a sending buffer 330, a memory 340, a receiving buffer 350 and a data verification circuit 360. The data driver 120 can include a second receiving buffer 210, a second parallel converter 220, a clock recovery circuit 230, a sensing circuit 240, an ADC 250, a second serializer 260 and a sending buffer 270.

The organic light emitting diode display device according to an embodiment of the present disclosure includes the timing controller 124 configured to output an EPI signal and the data driver 120 configured to generate a second internal clock signal using the EPI signal applied from the timing controller 124 and transfer a sensing data packet to timing controller 124 in synchronization with the second internal clock signal. The EPI signal includes an externally input control data and an EPI clock derived from a first internal clock signal PCLK_A. The timing controller 124 can include: the internal clock generator 320 configured to generate the first internal clock signal PCLK_A and a third internal clock signal PCLK_B with a different phase from the first internal clock signal PCLC_A; and the receiving buffer 350 configured to latch the sensing data packet using the first and third internal clock signals PCLK_A and PCLK_B. the first and third clock signals PCLK_A and PCLK_B have a phase difference of 180° therebetween. The internal clock generator 320 further generates fourth and fifth internal clock signals PCLK_C and PCLK_D each having different phases from those of the first and third internal clock signals PCLK_A and PCLK_B. The receiving buffer 350 can latch the sensing data packet using the fourth and fifth internal clock signals PCLK_C and PCLK_D. The phases of the first, third, fourth and fifth internal clock signals PCLK_A, PCLK_B, PCLK_C and PCLK_D have a difference of 90 from one another.

A data communication operation between the timing controller 124 and the data driver 120 will now be described in detail.

In order to realize the data communication, the present disclosure allows the timing controller 124 to be connected to the data driver circuits 128 in a point-to-point mode. As such, the number of lines between the timing controller 124 and the data driver 120 can be minimized. The data communication of the present can be based on an EPI (clock embedded point-to-point interface) transfer protocol.

The EPI transfer protocol can satisfy the following three interface regulations.

(1) A sending end of the timing controller 124 is connected to a receiving end of the data driver 120 in a point-to-point mode through a single pair of data lines without sharing any line therewith.

(2) Any additional pair of clock lines is not connected between the timing controller 124 and the data driver 120. The timing controller 124 can transfer the clock signal, the control signal and the video data signal to the data driver 120 and receive the sensing data.

(3) The data driver 120 includes a built-in clock recovery circuit 230. As such, the timing controller 124 can supply the data driver 120 with one of a clock training pattern signal and a preamble signal which are used to lock output phase and frequency of the clock recovery circuit 230. The clock recovery circuit 230 built-in the data driver 120 can lock its output phase and then generate an internal clock in response to the clock training pattern signal and the clock signal which are input through the data line pair.

The timing controller 124 receives external timing signals, such as vertical and horizontal synchronous signals Vsync and Hsync, an external data enable signal DE, a main clock signal CLK and so on, from an external host system through an interface corresponding to one of an LVDS (low voltage differential signaling) interface, a TMDS (transition minimized differential signaling) interface and so on. Also, the timing controller 124 can be serially connected to the data driver 120 through a point-to-point interface. Moreover, the timing controller 124 can transfer digital video data RGB of an input image to the data driver 120 and control operation timings of the gate driver 118 and data driver 120, by being driven in a manner satisfying the above-mentioned EPI transfer protocol. To this end, the timing controller 124 can convert the clock training pattern signal (or EPI clock signal), the control data, the digital video data RGB of the input image and so on into a pair of difference signals and transfer the converted different signal pair to the data driver 120 via the single pair of data lines. The signals transferred from the timing controller 124 to the data driver 120 can include the external clock signal.

In detail, the first serializer 310 of the timing controller 124 re-arranges the parallel digital video data RGB of the input image into serial digital video data RGB and transfers the serial digital video data RGB to the first sending buffer 330 in synchronization with the internal clock signal PCLK which is generated in the internal clock generator 320. The first sending buffer 330 converts the serial digital video data RGB into the difference signal pair and transfers the converted difference signal pair.

The second receiving buffer 210 of the data driver 120 receives the difference signal pair which is transferred from the timing controller 124 through the data line pair. The clock recovery circuit 230 of the data driver 120 recovers the internal clock signal from the received EPI clock signal. The second parallel converter 220 can samples the control data and the digital video date bits included in the EPI signal using the recovered internal clock signal. The control data can include a control signal which requests to sense properties of the driving switch DR and the organic light emitting diode OLED. The sensing circuit 240 can sense the properties of the driving switch DR and the organic light emitting diode OLED and obtain the sensing data, in response to the control signal. The method of obtaining the sensing data is the same as the above-mentioned method. The sensing data regarding the properties of the driving switch DR and the organic light emitting diode OLED can include a threshold voltage of the driving switch and an operation voltage Voled of the organic light emitting diode OLED.

The sensing circuit 240 of the data driver 120 can include a sample holder. As such, the sensing circuit 240 can sample an analog signal regarding the sensing data in synchronization with the recovered clock signal which is applied from the clock recovery circuit 230 and hold the sampled analog signal while the held analog signal is converted into a digital signal by the ADC 250.

The second serializer 260 converts the digital signal corresponding to the sensing data into a serial digital signal (i.e., serial sensing data) and transfers the serial sensing data to the second sending buffer 270. The second sending buffer 270 can transfer the serial sensing data to the first receiving buffer 350 of the timing controller 124 in a bus LVDS (bus low voltage differential signaling) mode. The serial sensing data is formatted into a sensing data packet as shown in FIG. 22. The sensing data packet can include an initial character TS corresponding to an initial information, information data Data including sensing information, and a data check sum Check_Sum. The initial character TS is used to indicate a start point of normal data (i.e., a start point of the sensing data packet).

The first receiving buffer 350 can store the received data in synchronization with the internal clock signal PCLK which is applied from the internal clock generator 320.

The internal clock generator 320 can generate and output the internal clock signal PCLK using a clock generator such as an internal phase locked loop (PLL) or an internal delayed locked loop (DLL).

Figure 23A:
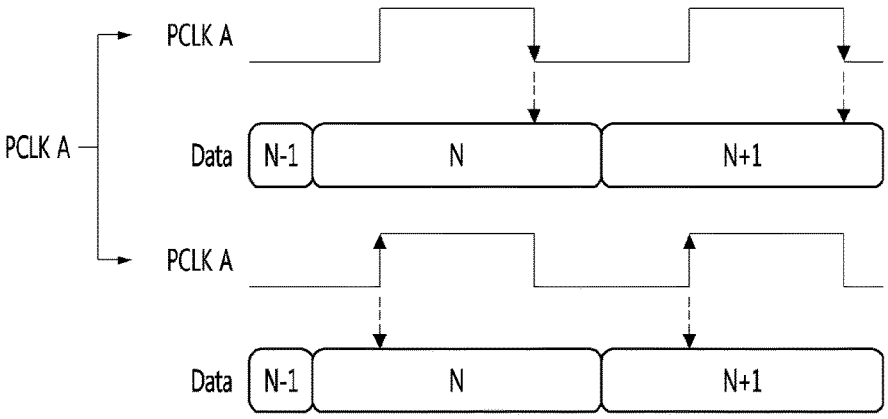
FIGS. 23A, 23B, 23C and 23D are diagrams illustrating a receiving and processing method of sensing data which is performed by the timing controller according to an embodiment of the present invention.
Figure 23B:
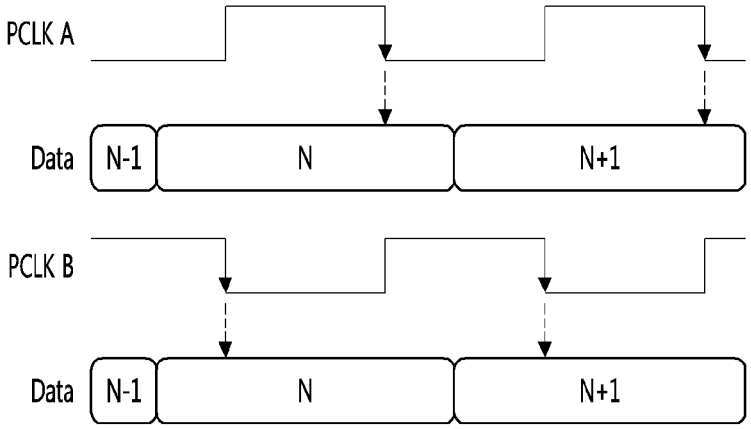
Figure 23C:
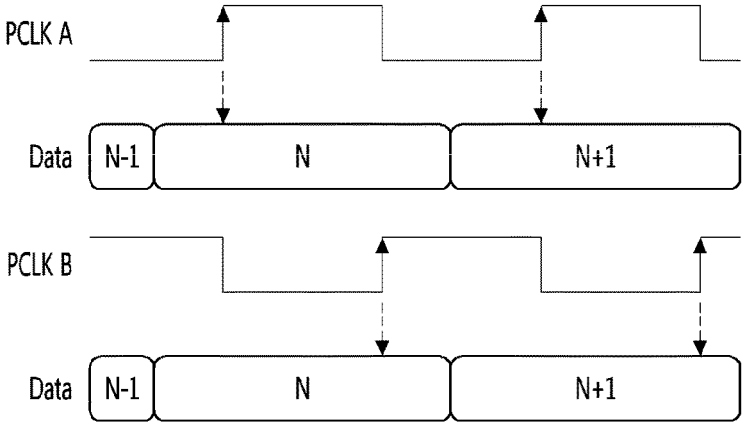
Figure 23D:
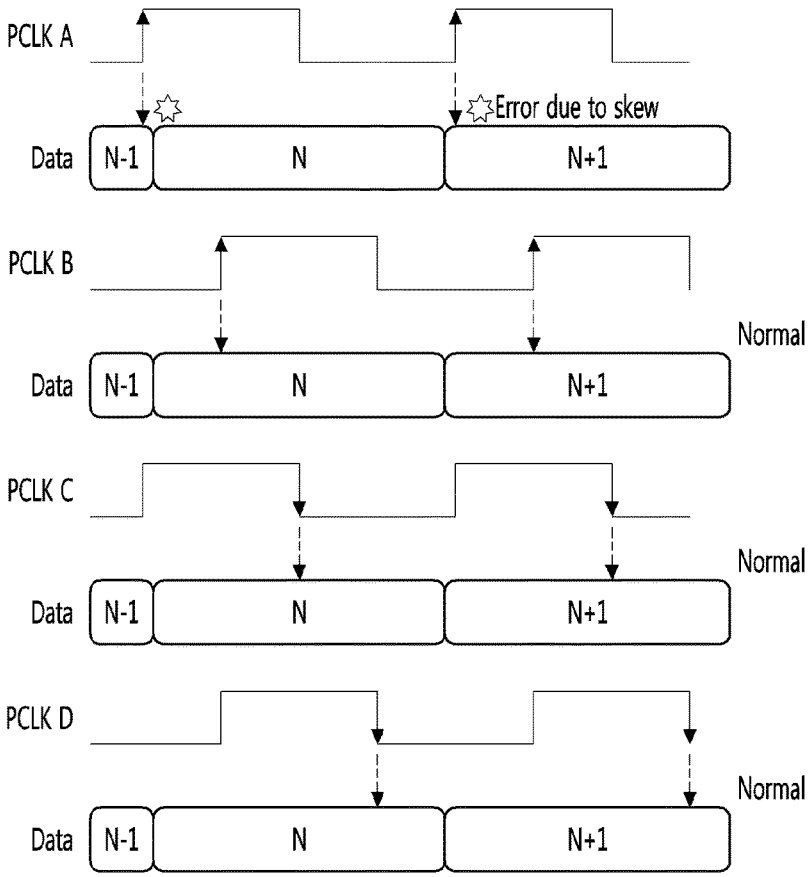

The internal clock generator 320 can generate a single internal clock signal PCLK_A or a plurality of internal clock signals PCLK_A, PCLK_B, PCLK_C and PCLK_D having different phases from one another. The first receiving buffer 350 can latch the sensing data packet in synchronization with one of rising and falling edges of the internal clock signal PCLK. If a single internal clock signal PCLK_A is applied as shown in FIG. 23A, the first receiving buffer 350 can include a buffer configured to latch the sensing data packet using the rising edge of the single internal clock signal PCLK_A and another buffer configured to latch the sensing data packet using the falling edge of the single internal clock signal PCLK_A. In other words, the first receiving buffer 350 can include two buffers. Alternatively, if two internal clock signals PCLK_A and PCLK_B having a phase difference of 180° therebetween are applied and the sensing data packet is latched one of the rising and falling edges of the two internal clock signals PCLK_A and PCLK_B as shown in FIGS. 23B and 23C, the first receiving buffer 350 can include two buffers opposite to the two internal clock signals PCLK_A and PCKL_B. In another different manner, four internal clock signals PCLK_A, PCLK_B, PCLK_C and PCLK_D having a phase difference of 180° therebetween are applied to the first receiving buffer 350 and the sensing data packet is latched one of the rising and falling edges of the four internal clock signals PCLK_A, PCLK_B, PCLK_C and PCLK_D as shown in FIG. 23D. In this case, the first receiving buffer 350 can include four buffers opposite to the four internal clock signals PCLK_A, PCKL_B, PCLK_C and PCLK_D.

Although the phase difference between the two internal clock signal PCLK_A and PCLK_B used in the first receiving buffer 350 is defined as 180° and the phase difference between the four internal clock signals PCLK_A, PCLK_B, PCLK_C and PCLK_D used in the first receiving buffer 350 is defined as 90°, the present disclosure is not limited to these. In other words, the phase difference between plural internal clock signals can be set to be a degree which allows the sensing data packet to be normally latched by at least one of the plural internal clock signals. Also, the number of buffers included in the first receiving buffer 350 can be determined on the basis of the number of internal clock signals and whether it uses one or both of the rising and falling edges of the internal clock signal. As such, the first receiving buffer 350 can receive store the sensing data packet transferred from the data driver 120 and store the sensing data packet into the buffers in accordance with the number of internal clock signals PCLK and the number of edge kinds of the internal clock signal PCLK.

For example, the internal clock generator 320 can generate first through fourth internal clock signals PCLK_A, PCLK_B, PCLK_C and PCLK_D. In this case, the first receiving buffer 350 can include first through fourth sub-buffers 351, 352, 353 and 354. The first through fourth sub-buffers 351, 352, 353 and 354 can latch the sensing data packet from the data driver 120 in synchronization with the first through fourth internal clock signals PCLK_A, PCLK_B, PCLK_C and PCLK_D.

As shown in FIG. 23D, the same data is latched by the first through fourth internal clock signals PCLK_A, PCLK_B, PCLK_C and PCLK_D as an example. In this case, it is confirmed that the data latched by the first internal clock signal PCLK_A includes an error due to a data skew but the data latched by the second through fourth internal clock signals PCLK_B, PCLK_C and PCLK_D maintains the normal state without any error. In other words, it can be confirmed that the data latched by at least one of plural internal clock signals is normal. In accordance therewith, the normal data can be received or obtained without correcting an error which is caused by the data skew of the data driver 120.

In this way, as the same data is latched by two internal clock signals with a phase difference of 180 therebetween, the data latched by one of two internal clock signals can surely maintain the normal state without any error. The data error due to the data skew caused by a non-synchronized internal clock signal can be removed. Moreover, when the same data is latched (or sampled) by four internal clock signals with a phase difference therebetween, a comparison process can be performed for verified data. As such, the data can be more accurately received or recognized.

[Data Verification Method]

The data verification circuit 360 can basically perform a detection of the initial character TS through the use of at least two internal clock signals and a check of a received sensing data packet based on the data check sum Check_sum in order to verify whether whether or not the received sensing data packet is a usable normal sensing data packet. To this end, the data verification circuit 360 can include: detecting the initial character TS with a fixed bit; comparing the same data bits, checking the data check sum. Check_sum; and selecting one of the same sensing data packets. In detail, the data verification circuit 360 can perform a first step of detecting the initial character TS from each of the multi-latched data packets, a second step of data-comparing the detected data packets, a third step of checking the data check sum Check_sum of the compared data packets, and a fourth step of selecting one of the checked data packets as a normal sensing data packet.

The sensing data packet transferred from the data driver 120 can be multi-latched by at least two internal clock signals PCLK. In the first step, the data verification circuit 360 can detect the initial character TS in each of the multi-latched data packets.

The data verification circuit 360 can perform a real-time data comparison between the data packets for the detected initial character to the data check sum and extract the same data packets among the multi-latched data packets, in the second step.

In the third step, the data verification circuit 360 can derive a check sum from the information data within each of the same data packets, compare the derived check sum and the received data check sum Check_Sum within each of the same data packets, and verify the same data packets.

The fourth step allows the data verification circuit 360 to select one of at least two verified data packets. The selected data packet is transferred from the data verification circuit 360 to the memory 340 and stored in the memory 340 as a usable normal data packet. As such, the timing controller 124 can compensate the digital video data RGB of the input image on the basis of the sensing data stored in the memory 340. Also, the timing controller 124 can transfer the compensated digital video data RGB to the data driver 120.

In this way, the organic light emitting diode display device according to an embodiment of the present disclosure can remove bus LVDS communication errors. In other words, the organic light emitting diode display device can remove the skew errors caused due to a non-synchronized clock by checking and verifying the received data packet using the plurality of internal clock signals PCLK. As such, it is not necessary for any additional component to correct the data skew. Also, the chip size of the data driver 200 can be reduced because such a skew correction component is removed.

Although the transferred data packet has any phase, at least one of plural internal clock signals can be synchronized with the transferred data packet. As such, the timing controller 124 can accurately receive the sensing data packet without any skew correction of the data driver 120. In other words, the timing controller 124 can normally receive real-time data without any skew correction even though impedance and properties of the data driver 120 are varied. In accordance therewith, the sensing data can be stably secured without modifying the configuration of the data driver 120. For example, the data driver 120 can secure the sensing data using only the existing clock signal without any new (or additional) clock signal. Therefore, mass productivity of the organic light emitting diode display device can become higher.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents without being limited to the description of the present disclosure.

What is claimed is:

1. An organic light emitting diode display device comprising:

a scan switch configured to apply one of a sensing voltage and a compensation data voltage on a data line to a first node in response to a scan pulse;

a sensing switch configured to apply a reference voltage on a sensing line to a second node in response to a sensing control signal;

a storage capacitor connected between the first and second nodes;

a driving switch configured to adjust an electric current based on a voltage between the first and second nodes; and an organic light emitting diode connected between the second node and a low potential driving voltage line, wherein:

the compensation data voltage is applied to the first node and the reference voltage is applied to the second node, in a first initialization interval;

a voltage on the second node is increased by turning-off the sensing switch in a driving switch property compensating interval;

the scan switch is turned-off and the reference voltage is applied to the second node by turning-on the sensing switch, in a second initialization interval; and the voltage of the second node is increased by driving the driving switch in one of a source follower mode and a constant current mode, wherein the scan switch is turned-off and the reference voltage is applied to the second node, in a third initialization interval, wherein the voltage on the second node is increased by floating the sensing line in an organic light emitting diode property sensing interval while the compensation data voltage is applied to the first node, wherein the voltage on the second node is detected via the sensing line in an organic light emitting diode property detecting interval for sensing an operation voltage of the organic light emitting diode after the driving switch has been compensated with the compensation data voltage, and wherein the organic light emitting diode property sensing interval is performed after the switch property compensating interval and before the organic light emitting diode property detecting interval.

2. The organic light emitting diode display device of claim 1, wherein the driving switch is driven in the source follower mode by turning-on the scan switch and turning-off the sensing switch during the organic light emitting diode property tracking interval.

3. The organic light emitting diode display device of claim 1, wherein the driving switch is driven in the constant current mode by turning-off the scan switch and the sensing switch during the organic light emitting diode property tracking interval.

4. The organic light emitting diode display device of claim 3, wherein in the organic light emitting diode property tracking interval, the scan switch is turned-on and transfers the compensation data voltage to the first node when the organic light emitting diode is turned-on.

5. A method of driving an organic light emitting diode display device which includes a scan switch configured to apply one of a sensing voltage and a compensation data voltage on a data line to a first node in response to a scan pulse, a sensing switch configured to apply a reference voltage on a sensing line to a second node in response to a sensing control signal, a storage capacitor connected between the first and second nodes, a driving switch configured to adjust a current on the basis of a voltage between the first and second nodes and an organic light emitting diode connected between the second node and a low potential driving voltage line, the method comprising:

performing a first initialization by applying the compensation data voltage to the first node and transferring the reference voltage to the second node;

compensating properties of the driving switch by turning-off the sensing switch and driving the driving switch in a source follower mode in a driving switch property compensating interval;

performing a second initialization by turning-off the scan switch and applying the reference voltage to the second node;

tracking a property of the organic light emitting diode by driving the driving switch in one of the source follower mode and a constant current mode while the compensation data voltage is applied to the first node and storing an operation voltage of the organic light emitting diode into the storage capacitor in an organic light emitting diode property tracking interval; and detecting the voltage on the second node via the sensing line in an organic light emitting diode property detecting interval for sensing an operation voltage of the organic light emitting diode after the driving switch has been compensated with the compensation data voltage, and wherein the organic light emitting diode property tracking interval is performed after the switch property compensating interval and before the organic light emitting diode property detecting interval.

6. The method of claim 5, further comprising:

performing a third initialization by turning-off the scan switch, turning-on the sensing switch and apply the reference voltage to the second node; and sensing the property of the organic light emitting diode by driving the driving switch in the source follower mode.

7. The method of claim 5, wherein the detection of the operation voltage of the organic light emitting diode includes applying a black data voltage to the first node by turning-on the scan switch.

8. The method of claim 7, wherein the compensation data voltage is obtained by:

performing an initialization by applying the sensing voltage to the first node and transferring the reference voltage to the second node;

storing the threshold voltage of the driving switch into the storage capacitor by driving the driving switch in the source follower mode;

detecting the threshold voltage of the driving switch from the voltage on the second node; and generating the compensation data voltage on the basis of the detected threshold voltage.

9. The method of claim 5, wherein the tracking of the property of the organic light emitting diode drives the driving switch in the constant current mode.

10. The method of claim 5, wherein the tracking of the property of the organic light emitting diode drives the driving switch in the source follower mode.

* * * * *